US012286724B1

(12) United States Patent
Smith et al.

(10) Patent No.: US 12,286,724 B1
(45) Date of Patent: Apr. 29, 2025

(54) POLYESTER COATING COMPOSITION FOR ELECTRODEPOSITION AND METHODS OF COATING A BEVERAGE END COIL SUBSTRATE

(71) Applicant: SWIMC LLC, Cleveland, OH (US)

(72) Inventors: Cassandra Smith, Coraopolis, PA (US); Arthur Riazzi, Harrison City, PA (US); Adam Cieslinski, Freeport, PA (US)

(73) Assignee: SWIMC LLC, Cleveland, OH (US)

( * ) Notice: Subject to any disclaimer, the term of this patent is extended or adjusted under 35 U.S.C. 154(b) by 0 days.

(21) Appl. No.: 18/394,063

(22) Filed: Dec. 22, 2023

Related U.S. Application Data

(60) Provisional application No. 63/476,823, filed on Dec. 22, 2022.

(51) Int. Cl.
*C25D 9/02* (2006.01)

(52) U.S. Cl.
CPC ..... *C25D 9/02* (2013.01)

(58) Field of Classification Search
None
See application file for complete search history.

(56) References Cited

U.S. PATENT DOCUMENTS

| | | | | |
|---|---|---|---|---|
| 3,956,091 | A | 5/1976 | Stepp | |
| 4,066,525 | A * | 1/1978 | Woo | C08L 63/00 204/500 |
| 4,605,476 | A | 8/1986 | Hart et al. | |
| 5,264,469 | A | 11/1993 | Mysliwczyk et al. | |
| 5,322,863 | A | 6/1994 | Figge et al. | |
| 5,451,304 | A | 9/1995 | Markfort et al. | |
| 5,635,049 | A | 6/1997 | Mysliwczyk et al. | |
| 6,423,774 | B1 * | 7/2002 | Zawacky | C09D 5/4423 524/901 |
| 7,949,716 | B2 * | 5/2011 | Alperovitch | H04L 51/212 709/219 |
| 9,650,176 | B2 | 5/2017 | Cavallin et al. | |
| 10,703,540 | B2 | 7/2020 | Cavallin et al. | |
| 11,142,374 | B2 | 10/2021 | Prouvost et al. | |
| 11,383,886 | B2 | 7/2022 | Cavallin et al. | |
| 2004/0171746 | A1 * | 9/2004 | Parekh | C08G 18/544 524/589 |
| 2007/0080065 | A1 * | 4/2007 | Oravitz | C08L 51/08 205/118 |
| 2008/0257748 | A1 * | 10/2008 | Kojima | C08K 9/04 205/316 |
| 2017/0022622 | A1 * | 1/2017 | Bao | C25D 13/16 |
| 2018/0009999 | A1 | 1/2018 | Bao et al. | |
| 2019/0186035 | A1 * | 6/2019 | Haghdoost | C09D 5/084 |
| 2019/0284400 | A1 * | 9/2019 | Maral | B65D 25/34 |
| 2020/0283647 | A1 * | 9/2020 | Yasuhara | B01J 13/125 |

FOREIGN PATENT DOCUMENTS

| | | | | |
|---|---|---|---|---|
| DE | 19635560 | * | 3/1998 | C25D 13/12 |
| WO | 2007044359 | A2 | 4/2007 | |

* cited by examiner

*Primary Examiner* — Stefanie S Wittenberg
(74) *Attorney, Agent, or Firm* — Honigman LLP

(57) ABSTRACT

The disclosure provides a polyester polymers, and aqueous polyester-based coating composition, for use in forming coatings via electrodeposition. The disclosure also provides materials and methods for electrodepositing coating compositions onto metal substrates, and particularly coil substrates for beverage can ends.

17 Claims, No Drawings

POLYESTER COATING COMPOSITION FOR ELECTRODEPOSITION AND METHODS OF COATING A BEVERAGE END COIL SUBSTRATE

CROSS-REFERENCE TO RELATED APPLICATION

This application claims the benefit of priority under 35 U.S.C. § 119 to U.S. Provisional Application No. 63/476,823, filed on Dec. 22, 2022, which is incorporated herein by reference in its entirety

TECHNICAL FIELD

The present disclosure relates generally to the field of polymers and, more specifically, to the field of polyester polymers for use in electrodeposition coating compositions and methods therefor, including, for example, packaging coatings for use on packaging containers.

BACKGROUND

A wide variety of coatings have been used to coat the surfaces of food and beverage containers. Traditionally, the food or beverage containers are often coated using so-called "coil coating" operations where a planar sheet of a metal substrate (e.g., steel or aluminum metal) is coated by spray or roll coating methods with a suitable composition, and then cured. The coated coil substrate is subsequently formed into the container end or body. Beverage can ends are typically formed from suitably coated aluminum coil. The coating should preferably be capable of high-speed application to the substrate and provide the necessary properties when cured to perform in this demanding end use. For example, the coating should preferably be safe for prolonged food contact, have excellent adhesion to the substrate, be capable of being drawn or otherwise fabricated during the forming step(s), provide clean edges when the can end is opened to access the packaged product, resist staining and other coating defects, and resist degradation over long periods of time when exposed to harsh environments.

There are a few shortcomings associated with conventional coil coating operations that commonly use spray or roll coating application methods for food or beverage containers. For one, uniform thickness over the length of the planar substrate can be a challenge in coil coating operations due to the size of the planar sheet. To improve coating uniformity, e-coating or electrodeposition methods are an alternative coating method that can provide more uniform coating applications over a large surface and, previously, epoxy-based coating compositions have been used for electrodeposition in industrial coil coating operations for food or beverage containers. However, the trend in the coating industry for food and beverage containers is to use aqueous coating compositions with low levels of volatile organic compounds (VOCs) and/or compositions that do not include bisphenol-A (BPA) and/or related compounds.

Prior attempts at creating a low VOC and/or a BPA-free, epoxy-based aqueous coating composition suitable for electrodeposition have been met with challenges and, particularly, for electrodeposition coatings used on interior surfaces of food or beverage containers because, not only does the coating need to meet critical quality requirements for the electrodeposition process, but the coating must also meet the required stringent balance of coating characteristics for the demanding end use of an interior food or beverage container (e.g., safety for food-contact, flexibility, adhesion, corrosion resistance, stability, resistance to crazing, etc.). For example, there has typically been a tradeoff between corrosion resistance and fabrication properties for such coatings, and especially for beverage can ends. Polyester-based coatings suitable for food-contact that have exhibited both good fabrication properties and an absence of crazing have tended to be too soft and exhibit unsuitable corrosion resistance. Conversely, polyester-based coatings suitable for food contact that have exhibited good corrosion resistance have typically exhibited poor flexibility and unsuitable crazing when fabricated. Attempting to balance processing requirements for electrodeposition of a low VOC and BPA-free polyester coating at the same time has been met with difficulties.

Selected Definitions

Unless otherwise specified, the following terms as used herein have the meanings provided below.

As used herein, the term "organic group" means a hydrocarbon group (with optional elements other than carbon and hydrogen, such as oxygen, nitrogen, sulfur, and silicon) that is classified as an aliphatic group, cyclic group, or combination of aliphatic and cyclic groups (e.g., alkaryl and aralkyl groups). The term "aliphatic group" means a saturated or unsaturated linear or branched hydrocarbon group. This term is used to encompass alkyl, alkenyl, and alkynyl groups, for example. The term "alkyl group" means a saturated linear or branched hydrocarbon group including, for example, methyl, ethyl, isopropyl, t-butyl, heptyl, dodecyl, octadecyl, amyl, 2-ethylhexyl, and the like. The term "alkenyl group" means an unsaturated, linear or branched hydrocarbon group with one or more carbon-carbon double bonds, such as a vinyl group. The term "alkynyl group" means an unsaturated, linear or branched hydrocarbon group with one or more carbon-carbon triple bonds. The term "cyclic group" means a closed ring hydrocarbon group that is classified as an alicyclic group or an aromatic group, both of which can include heteroatoms. The term cycloaliphatic group means an organic group that contains a ring that is not an aromatic group.

A group that may be the same or different is referred to as being "independently" something. Substitution is anticipated on the organic groups of the compounds of the present disclosure. As a means of simplifying the discussion and recitation of certain terminology used throughout this application, the terms "group" and "moiety" are used to differentiate between chemical species that allow for substitution or that may be substituted and those that do not allow or may not be so substituted. Thus, when the term "group" is used to describe a chemical substituent, the described chemical material includes the unsubstituted group and that group with O, N, Si, or S atoms, for example, in the chain (as in an alkoxy group) as well as carbonyl groups or other conventional substitution. Where the term "moiety" is used to describe a chemical compound or substituent, only an unsubstituted chemical material is intended to be included. For example, the phrase "alkyl group" is intended to include not only pure open chain saturated hydrocarbon alkyl substituents, such as methyl, ethyl, propyl, t-butyl, and the like, but also alkyl substituents bearing further substituents known in the art, such as hydroxy, alkoxy, alkylsulfonyl, halogen atoms, cyano, nitro, amino, carboxyl, etc. Thus, "alkyl group" includes ether groups, haloalkyls, nitroalkyls, carboxyalkyls, hydroxyalkyls, sulfoalkyls, etc. On the other hand, the phrase "alkyl moiety" is limited to the inclusion of only pure open chain saturated hydrocarbon alkyl substituents, such as methyl, ethyl, propyl, t-butyl, and the like. As used herein, the term "group" is intended to be a recitation of both the particular moiety, as well as a recitation of the broader class of substituted and unsubstituted structures that encompasses the moiety.

The term "double bond" refers to any type of double bond between any suitable atoms (e.g., C, O, N, etc.), but excludes aromatic double bonds.

The term "triple bond" is non-limiting and refers to any type of triple bond between any suitable atoms.

The terms "unsaturated" or "unsaturation" when used in the context of a material or group refers to a material or group that includes at least one non-aromatic double bond or triple bond, more typically a non-aromatic carbon-carbon double bond.

As used herein, the term "substantially free" when used with respect to a composition that may contain a particular compound means that the composition contains less than 1,000 parts per million (ppm) of the recited compound regardless of the context of the compound in the composition (e.g., regardless of whether the compound is present in unreacted form, in reacted form as a structural unit of another material, or a combination thereof). The term "essentially free" when used with respect to a composition that may contain a particular compound means that the composition contains less than 100 parts per million (ppm) of the recited compound regardless of the context of the compound in the composition (e.g., regardless of whether the compound is present in unreacted form, in reacted form as a structural unit of another material, or a combination thereof). The term "essentially completely free" when used with respect to a coating composition that may contain a particular compound means that the coating composition contains less than 5 parts per million (ppm) of the recited compound regardless of the context of the compound in the composition (e.g., regardless of whether the compound is present in unreacted form, in reacted form as a structural unit of another material, or a combination thereof). The term "completely free" when used with respect to a composition that may contain a particular compound means that the composition contains less than 20 parts per billion (ppb) of the recited compound regardless of the context of the compound in the composition (e.g., regardless of whether the compound is present in unreacted form, in reacted form as a structural unit of another material, or a combination thereof). When the phrases "free", "free of" (outside the context of the aforementioned phrases), "do not contain", "does not contain", "does not include any" and the like are used herein, such phrases are not intended to preclude the presence of trace amounts of the pertinent structure or compound which may be present but were not intentionally used, e.g., the presence of environmental contaminants.

The term "crosslinker" refers to a molecule capable of forming a covalent linkage between polymers or between two different regions of the same polymer.

The term "water-dispersible" in the context of a water-dispersible polymer means that the polymer can be mixed into water (or an aqueous carrier) to form a stable mixture. For example, a mixture that separates into different layers after being stored for 12 hours at 21° C. under normal storage conditions is not a stable mixture. The term "water-dispersible" is intended to include the term "water-soluble." In other words, by definition, a water-soluble polymer is also considered to be a water-dispersible polymer.

The term "dispersion" in the context of a dispersible polymer refers to the mixture of a dispersible polymer and a carrier. The term "dispersion" is intended to include the term "solution."

Unless otherwise indicated, a reference to a "(meth) acrylate" compound (where "meth" is bracketed) is meant to include both acrylate and methacrylate compounds.

As used herein, "monomer" or reactant generally refers to a compound within a reaction mixture prior to polymerization and monomer units or (alternatively) repeating units or structural units refers to the monomer or reactant within the polymer. Preferably, the various monomers or reactants herein are randomly polymerized monomer units, structural units, or repeating units. If the discussion herein refers to a monomer or reactant, it also implies the resultant monomer unit, structural unit, or repeating unit thereof in the polymer. Likewise, if the discussion refers to a monomer unit, structural unit, or repeating unit, it also implies the monomer or reactant mixture used to form the polymer with the associated units therein.

The term "epoxy-free", when used herein in the context of a polymer, refers to a polymer that does not include any "epoxy backbone segments" (viz., segments formed from reaction of an epoxy group and a group reactive with an epoxy group). By way of example, a polymer made from ingredients including an epoxy resin would not be considered epoxy-free. Similarly, a polymer having backbone segments that are the reaction product of a bisphenol (e.g., bisphenol A, bisphenol F, bisphenol S, 4,4'dihydroxy bisphenol, etc.) and a halohydrin (e.g., epichlorohydrin) would not be considered epoxy-free. However, a vinyl polymer formed from vinyl monomers or oligomers that include a pendant epoxy moiety (e.g., glycidyl methacrylate) would be considered epoxy-free because the vinyl polymer would be free of epoxy backbone segments. Coating compositions that are referred to as "epoxy-free" are not made using any polymers or other material having epoxy backbone segments.

The term "on," when used in the context of a coating applied on a surface or substrate, includes both coatings applied directly or indirectly to the surface or substrate. Thus, for example, a coating applied to a primer layer overlying a substrate constitutes a coating applied on the substrate.

Unless otherwise indicated, the term "polymer" includes both homopolymers and copolymers (i.e., polymers of two or more different monomers). Thus, for example, the term "polyester polymer" includes copolyesters.

As used herein, "Volatile Organic Compound" or VOC generally refers to organic compounds that have a high vapor pressure at room temperature. In many cases, VOCs are compounds with a vapor pressure of greater than about 0.1 mm of Hg. VOC as reported herein is measured according to ASTM D2369-90 and is the weight of the VOC per volume of the coating in kg/L. As used herein, low VOC or substantially free of VOCs means less than about 1.2 kg/L, in other approaches, less than 1.0 kg/L of volatile organic content, less than about 0.8 kg/L of volatile organic content, less than about 0.5 kg/L of volatile organic content, less than about 0.4 kg/L of volatile organic content, or less than about 0.3 kg/L of volatile organic content. In another approach, VOC refers to anything that elutes from GC before methyl palmitate.

As used herein, "glass transition temperature" or "Tg" generally refers to a temperature region where an amorphous polymer transitions from a hard, glassy material to a softer, rubbery material. Typically, this transition is reversible.

Unless noted otherwise, Tg is measured by differential scanning calorimetry (DSC), such as with a TA Instruments Q200 differential scanning calorimeter or the like instrument. To measure Tg using DSC, a sample deposited on a panel first is baked in a Fisher ISOTEMP™ electric oven for 20 minutes at 149° C. (300° F.) to remove volatile materials. After cooling to room temperature, samples are scraped from the panels, weighed into standard sample pans and analyzed using the standard DSC heat-cool-heat method. The samples were equilibrated at −60° C., then heated at 20° C. per minute to 200° C., cooled to −60° C., and the heated again at 20° C. per minute to 200° C. Glass transitions are calculated from the thermogram of the last heat cycle. The glass transitions are measured at the inflection point of the transition.

The term "comprises" and variations thereof do not have a limiting meaning where these terms appear in the description and claims.

The terms "preferred" and "preferably" refer to embodiments of the disclosure that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure.

As used herein, "a," "an," "the," "at least one," and "one or more" are used interchangeably. Thus, for example, a coating composition that comprises "an" additive can be interpreted to mean that the coating composition includes "one or more" additives.

Also herein, the recitations of numerical ranges by endpoints include all numbers subsumed within that range (e.g., 1 to 5 includes 1, 1.5, 2, 2.75, 3, 3.80, 4, 5, etc.). Furthermore, disclosure of a range includes disclosure of all subranges included within the broader range (e.g., 1 to 5 discloses 1 to 4, 1.5 to 4.5, 1 to 2, etc.).

SUMMARY

In one embodiment, a method of coating a beverage end coil substrate in an industrial coating line is described herein. In one aspect, the method includes contacting the beverage end coil substrate with an aqueous coating composition, wherein the beverage end coil is positively charged; electrodepositing coating solids from the aqueous coating composition onto the beverage end coil substrate, wherein the aqueous coating composition includes more than about 60 weight percent, based on resin solids, of a polyester polymer and less than about 1.2 kg/L of volatile organic content as measured pursuant to ASTM D2369-90, based on the total weight of the aqueous coating composition; and curing the deposited coating solids to form a hardened coating on the beverage end coil substrate.

In another embodiment, the method of the previous paragraph includes one or more other features in any combination. The other features include one or more of the following: wherein the polyester is an aromatic polyester polymer; and/or wherein the hardened coating has a dry film weight of about 4 milligrams per square inch or less, preferably about 1.5 to about 3 milligrams per square inch; and/or wherein the beverage end coil substrate is aluminum; and/or wherein the aluminum beverage end coil is cleaned only aluminum; and/or wherein the beverage end coil substrate is moving through the industrial coating line at a line speed of at least about 500 feet per minute; and/or wherein the beverage end coil substrate contacts the aqueous coating composition in a bath, and wherein a given area of the beverage end coil substrate is within the bath for a duration of less than about 10 seconds, more typically less than about 5 seconds; and/or wherein the beverage end coil substrate is aluminum and has an average thickness of about 175 micrometers to about 230 micrometers; and/or wherein the hardened coating is an interior beverage end coating; and/or wherein the interior coating, when the beverage end coil substrate is formed into a fully converted 202 standard opening beverage can end, passes less than about 40 milliamps, less than 30 milliamps, less than 20 milliamps, less than about 10 milliamps, or 0 milliamps of current when tested in accordance with the Porosity Test for initial porosity; and/or wherein the polyester polymer includes one or more anionic groups; and/or wherein the anionic groups include base-neutralized acid or anhydride groups; and/or wherein the base includes a nitrogen-containing base; and/or wherein the base includes an amine, preferably triethyl amine (TEA); and/or wherein the anionic groups are located in a pendant group attached to a backbone of the polyester polymer; and/or wherein the pendant group includes a reaction product of an unsaturated compound having at least one salt or salt-forming group, and wherein the pendant group is attached to another portion of the polymer via reaction of the unsaturated compound with one or more double or triple bonds, with the proviso that the reaction of the unsaturated compound with the one or more double or triple bonds does not require the participation of a free-radical initiator; and/or wherein the pendant group includes a reaction product of an unsaturated compound having at least one salt or salt-forming group, and wherein the pendant group is attached to another portion of the polymer via reaction, such as a pericyclic reaction, of the unsaturated compound with one or more double or triple bonds; and/or wherein the pendant group is a Diels-Alder reaction product; and/or wherein the pendant group is an Ene reaction product; and/or wherein the polyester polymer includes a plurality of the pendant groups and at least one of the pendant groups is a Diels-Alder reaction product and at least one of the pendant groups is an Ene reaction product; and/or wherein the polyester polymer comprises a salt of an acid- or anhydride-functional polyester polymer and a nitrogen-containing base.

In yet another embodiment, a method of electrodepositing coating solids to a surface of a metal substrate is described herein. In one aspect, the method includes contacting the metal substrate with an aqueous coating composition; electrodepositing coating solids from the aqueous coating composition onto a surface of the metal substrate; and wherein the aqueous coating composition includes a polyester polymer, preferably an aromatic polyester polymer; less than about 1.2 kg/L of volatile organic content, based on the total weight of the aqueous coating composition; and curing the electrodeposited coating to form a cured coating on the metal substrate.

In other embodiment, the method of any embodiment herein may include other features in any combination. Such other features may include one or more of the following: wherein the polyester polymer has a cycloaliphatic group and a pendant group attached to the cycloaliphatic group and wherein the pendant group includes at least one salt group; and/or wherein the pendant group is attached to the cycloaliphatic group via a carbon-carbon bond; and/or wherein the pendant group is attached to the polyester polymer via a cycloaddition reaction; and/or wherein the cycloaddition reaction is a Diels-Alder reaction; and/or wherein the surface of the metal substrate is a food- or beverage-contacting surface of a can metal substrate; and/or wherein the metal substrate is aluminum coil for beverage can ends; and/or wherein the polyester polymer has an acid number of about 20 to about 25 mg KOH/g resin; and/or wherein the polyester polymer has a hydroxyl number of about 10 to about 20 mg KOH/g resin; and/or wherein the polyester polymer is unsaturated; and/or wherein the cycloaliphatic group has at least one carbon-carbon double bond present in a ring of the cyclic group; and/or wherein the polyester polymer has a glass transition temperature (Tg) as measured by DSC of about 25° C. to about 60° C.; and/or wherein the polyester polymer has a number average molecular weight determined by GPC using polystyrene standards of at least about 2,000 or about 2,500 to about 10,000, preferably about 3,000 to about 8,000, and more preferably about 4,000 to about 6,000; and/or wherein the aqueous coating composition includes less than 1.0 kg/L of volatile organic content, less than about 0.8 kg/L of volatile organic content, less than about 0.5 kg/L of volatile organic content, less than about 0.4 kg/L of volatile organic content, or less than about 0.3 kg/L of volatile organic content as measured pursuant to ASTM D2369-90; and/or wherein the aqueous coating composition includes, based on total solids, more than 70 weight percent of the polyester polymer; and/or wherein the aqueous coating composition is a concentrate having about 20 to about 30 weight solids; and/or wherein the concentrate is diluted to about 5 to about 12 weight percent solids for the electrodepositing; and/or wherein a particle size of the polyester polymer in the aqueous coating composition is about 0.05 to about 0.15 microns as measured by laser diffraction.

In yet another embodiment, a concentrate suitable for an aqueous electrocoating composition having low volatile organic content levels is provided herein. In one aspect, the concentrate includes a water-dispersible polyester polymer, preferably an aromatic polyester polymer, with acid-functional pendant groups and obtained from reactants including one or more polyacid monomers, one or more polyol monomers, one or more acid-functional monomers selected from a polyanhydride monomer or an acid-functional unsaturated reactant, or both, and wherein at least a portion of the acid-functional groups of the acid-functional ethylenically unsaturated reactants are at least partially neutralized with a base to provide the water-dispersiblity; a crosslinker; and wherein the concentrate has less than about 1.2 kg/L of volatile organic content, less than 1.0 kg/L of volatile organic content, less than about 0.8 kg/L of volatile organic content, less than about 0.5 kg/L of volatile organic content, less than about 0.4 kg/L of volatile organic content, or less than about 0.3 kg/L of volatile organic content as measured by ASTM D2369-90.

In other embodiments, the methods of this Summary and/or the concentrate of this summary may include other features in any combination. Such other features may include on or more of the following: wherein the base is a tertiary amine and preferably triethyl amine (TEA); and/or wherein the one or more polyacid molecules include adipic acid, azelaic acid, cyclohexane dicarboxylic acid, fatty acid-based materials, fatty acid dimers, fumaric acid, maleic acid, phthalic acid, sebacic acid, succinic acid, glutaric acid, terephthalic acid, isophthalic acid, anhydrides thereof, esters thereof, or a mixture thereof; and/or wherein the reactants include one or more acid-functional unsaturated reactants; and/or wherein the one or more acid-functional unsaturated reactants includes sorbic acid, maleic acid, fumaric acid, nadic acid, tetrahydrophthalic acid, anhydride derivatives thereof, or combinations thereof; and/or wherein the one or more acid-functional unsaturated reactants includes the combination of sorbic acid and maleic anhydride; and/or wherein the water-dispersible polyester polymer includes a structural unit in the polymer backbone derived from maleic anhydride; and/or wherein the sorbic acid is a pendant group to the polyester backbone attached to the maleic anhydride via a Diels-Alder reaction and/or a Ene reaction; and/or wherein the sorbic acid is a base neutralized sorbic acid; and/or wherein the water-dispersible polyester polymer includes a cycloaliphatic group having at least one carbon-carbon double bond present in a ring of the cyclic group; and/or wherein any cycloaliphatic group is derived from the maleic anhydride and sorbic acid reactants; and/or wherein the reactants include the polyanhydride, preferably a dianhydride; and/or wherein the reactants include polyanhydride, and the polyanhydride comprises pyromellitic dianhydride (PMDA); and/or wherein the one or more polyol molecules include ethylene glycol, propylene glycol, butylene glycol, neopentyl glycol, cyclohexane diol, a dimer fatty diol, cyclohexane dimethanol, hexane diol, 2-methyl-1,3-propane diol, 2-butyl-2-ethyl-1,3-propanediol, a substituted butane diol, a substituted pentane diol, a substituted hexane diol, a methylol cycloalkane, diethylene glycol, 2,2,4,4-tetramethyl-1,3-cyclobutanediol, tricyclodecanedimethanol, 3,9-bis(1,1-dimethyl-2-hydroxyethyl)-2,4,8,10-tetraoxaspiro[5.5]undecane, a triol, or a combination thereof; and/or wherein the crosslinker further includes an aminoplast crosslinker, a resole phenolic crosslinker, or combinations thereof; and/or wherein the polyester polymer has a glass transition temperature (Tg) of at least about 25° C.; and/or wherein the polyester polymer has a number average molecular weight, as measured using gel permeation chromatography ("GPC") using polystyrene reference standards, of at least about 2,000 or about 2,500 to about 10,000, preferably about 3,000 to about 8,000, and more preferably about 4,000 to about 6,000; and/or wherein the concentrate includes, based on total solids, more than about 60 weight percent of the aromatic polymer and preferably more than about 70 weight percent of the aromatic polymer; and/or wherein the polyester polymer has an acid number of about 20 to about 25 mg KOH/g resin; and/or wherein the polyester polymer has a hydroxyl number of about 10 to about 20 mg KOH/g resin; and/or wherein the polyester polymer has a glass transition temperature (Tg) of about 25° C. to about 60° C.; and/or wherein the polyester polymer is an aromatic polyester polymer.

In other embodiments, the present disclosure further provides for a coating composition as recited in any embodiment of this Summary and/or a coating composition formed from any embodiment of the concentrate of this Summary.

In further embodiments, an article including a riveted food or beverage can end comprising, on at least a portion thereof, a coating provided by electrodeposting coating solids from any embodiment of the aqueous coating composition and/or the concentrate as described in this Summary.

In other embodiments, the composition, the methods, the concentrate, and or the article of this summary may further include other embodiments in any combination. These other embodiment may include one or more of the following: wherein the concentrate is diluted to about 5 to about 15 weight percent solids in the aqueous coating composition; and/or wherein the aqueous coating composition thereof is substantially epoxy free, substantially bisphenol free, or both; and/or wherein the aqueous coating composition thereof is substantially free of each of bisphenol A, bisphenol F, or bisphenol S, or any epoxides thereof; and wherein the coating composition is optionally substantially free of styrene; or wherein the coating composition does not contain any bisphenol A, bisphenol F, bisphenol S, epoxides thereof, or styrene or structural units derived from bisphenol A, bisphenol F, bisphenol S, epoxides thereof, or styrene; and/or wherein the aqueous coating composition thereof is substantially free of isocyanate-derived moieties; and/or wherein the polyester polymer is substantially free of acrylic or acrylate derived moieties; and/or wherein the cured coating exhibits a MEK solvent resistance is at least 30 double rubs; and/or wherein a riveted beverage can end formed from the method, the concentrate, or the article exhibits feathering, if any, below 0.2 inches (0.508 cm), more preferably below 0.1 inches (0.254 cm), most preferably below 0.05 inches (0.127 cm), and optimally 0.02 inches or lower (0.051 cm) when tested as described herein; and/or wherein the coating composition is cured in no more than 5 seconds, no more than 4 seconds, or no more than 3 seconds to a peak metal temperature of at least about 400° F.; and/or wherein the coating composition or the concentrate further includes a lubricant; and/or wherein the lubricant is selected from Carnauba wax, polyethylene-based wax, Fischer-tropsch wax, fatty acid ester wax, silicon-based wax, lanolin wax, hydroxyl-functional poly siloxane wax or combinations thereof; and/or wherein the water-dispersible polyester polymer is preferably an aromatic polyester polymer with acid-functional pendant groups and obtained from reactants including one or more polyacid monomers, one or more polyol monomers, one or more acid-functional monomers selected from a polyanhydride monomer or an acid-functional unsaturated reactant, or both.

In yet another embodiments, a method of causing the concentrate or the compositions of any embodiment of this Summary to be used to coat a beverage can end substrate.

DETAILED DESCRIPTION

In one aspect, the present disclosure provides materials and methods for functionalizing a polymer, such as a polyester polymer and preferably an aromatic polyester polymer, to include one or more functional groups suitable for aqueous coating compositions to be used in electrodepositing coating methods for food or beverage end coil substrates. In one approach, the aqueous coating composition may be a concentrate that is diluted to a predetermined solids content for the electrodepositing process. In another approach or embodiment, the functionalization may be conducted on a preformed unsaturated polymer. When used, the functionalization process typically consumes at least one double or triple bond of the unsaturated polymer. After functionalization, the molecular weight of the functionalized polymer may optionally be increased if desired. Alternatively, an unsaturated prepolymer (e.g., an oligomer or low-molecular-weight polymer) may be functionalized and upgraded to the desired final molecular weight after functionalization. The final functionalized polymer will typically be unsaturated, but it may be optionally modified (e.g., via hydrogenation) to yield a saturated polymer.

The added functionality of the polyester polymers herein may confer one or more benefits to the polymer such as, for example, providing sites for crosslinking, facilitating water dispersibility of the polyester polymer into an aqueous medium, improving the compatibility of the polymer with one or more other materials, improving adhesion of the cured coating to substrate, and so on. The one or more added functional groups may be present at any suitable location, including for, example, at terminal backbone locations, at pendant group locations (e.g., present in a side group attached directly to the polymer backbone or in a side group that may be separated from the polymer backbone by one or more branch points), and combinations thereof.

In some embodiments, the addition of water-dispersing groups via functionalization may not require the participation of carbon-carbon double bonds. For example, in some embodiments, a polyester prepolymer is reacted with a polyanhydride (more typically a dianhydride such as, e.g., pyromellitic dianhydride) to yield a water-dispersible polyester.

In one approach or embodiment, methods are described herein for coating a beverage end coil substrate in an industrial coating line using electrodepositing. The methods include contacting the beverage end coil substrate with an aqueous coating composition and then electrodepositing coating solids from the aqueous coating composition onto the beverage end coil substrate. In one approach, the aqueous coating composition may include more than about 60 weight percent, based on resin solids, of a water-dispersible polyester polymer (preferably, a water-dispersible aromatic polyester polymer) and low levels of VOCs with less than about 1.2 kg/L of volatile organic content, based on the total weight the aqueous coating composition. The aqueous coating compositions herein are preferably free of, or substantially free of, each of bisphenol A, bisphenol F, or bisphenol S, and any epoxides thereof. In presently preferred embodiments, the coating composition are also free of, or substantially free of styrene-based moieties.

In the methods herein, the coil substrate, which is typically a beverage end coil substrate, is often moving through an industrial coating line at a line speed of at least about 500 feet per minute, and the coil substrate contacts the aqueous coating composition in an aqueous electrodeposition bath for only a very short time, such as wherein a given area of the coil substrate is only within the bath for a duration of less than about 10 seconds, more typically less than about 5 seconds. Curing of the electrodeposited solids in the methods herein may be even faster, with cure times of no more than 5 seconds, no more than 4 seconds, or no more than 3 seconds (suitably for a peak metal temperature of at least about 400° F.). Even with such fast coating speeds and short curing durations, the compositions herein are effective for curing the electrodeposited coating solids to form a hardened coating on beverage end coil substrate meeting the stringent balance of requirements for an interior food or beverage container end that may also include a rivet. The term "hardened" does not imply anything related to the relative hardness or softness (e.g., Tg, scratch resistance, etc.) of a coating.

In approaches, the hardened coating may have a dry film weight of about 4 milligrams per square inch or less, and preferably about 1.5 to about 3 milligrams per square inch. In preferred embodiments, the hardened coating is an interior coating for a food or beverage container and, preferably, for beverage containers. In particularly preferred embodiments, the coating composition is applied to beverage end coil substrate and hardened. In such embodiments, when the beverage end coil substrate is formed into a fully converted 202 standard opening beverage can end, the hardened coating preferably passes less than about 40, less than about 30, less than about 25, less than about 20, less than about 15, and in other approaches less than about 10 milliamps of (or preferably 0 milliamps) current when tested in accordance with the Porosity Test for initial porosity (coated substrates may be measured using a WACO Enamel Rater II, available from the Wilkens-Anderson Company, Chicago, IL, with an output voltage of 6.3 volts. The measured electrical current is reported in milliamps.)

In approaches or embodiments, the aqueous coating composition may be derived from a concentrate suitable for an electrocoating and wherein the concentrate also has low volatile organic content levels. In one approach, the concentrate includes a water-dispersible aromatic polyester polymer with acid-functional pendant groups (which are typically at least partially neutralized) and obtained from reactants including one or more polyacid monomers, one or more polyol monomers, one or more acid-functional monomers selected from a polyanhydride monomer or an acid-functional unsaturated reactant, or both, and wherein at least a portion of the acid-functional groups provided in the polyester by the acid-functional ethylenically unsaturated reactants or polyanhydride reactants are neutralized with a base to provide the water-dispersibility. The concentrate preferably includes a crosslinker (preferably an external crosslinker compound in addition to the polyester), and preferably has less than about 1.2 kg/L of volatile organic content, less than 1.0 kg/L of volatile organic content, less than about 0.8 kg/L of volatile organic content, less than about 0.5 kg/L of volatile organic content, less than about 0.4 kg/L of volatile organic content, or less than about 0.3 kg/L of volatile organic content.

The concentrate, in various embodiments, may have about 20 to about 30 weight percent total solids, and the concentrate may then be diluted to about 5 to about 15 weight percent total solids for an aqueous coating composition suitable for the electrodepositing processes herein. In some approaches, the concentrate and/or the subsequent finished coating composition includes, based on total solids, more than about 60 weight percent of the polyester polymer (preferably an aromatic polyester polymer) and more preferably more than about 70 weight percent of the polyester polymer (preferably the aromatic polyester polymer).

The coil coating compositions herein are suitable for metal substrates and electrodeposition coil coating conditions and application methods. In some approaches, the metal substrate is a metal typically used in the beverage packaging industry. In one approach, the metal substrate includes steel, aluminum, or a combination thereof. Preferably, the metal substrate is aluminum, and in some embodiments a chromium-free, pre-treated aluminum. The metal substrate may be formed into a beverage can end (e.g., via a stamping process) and may include a riveted beverage can end. In one approach, the aluminum substrate may have an average thickness of about 175 micrometers to about 230 micrometers. The beverage coil substrates may have a width of about 5 inches up to about 70 inches. In preferred embodiments, the aluminum beverage end coil substrate is a cleaned only aluminum substrate.

In yet other embodiments, the metal used to form the substrates herein could be subjected to one or more pretreatment steps by the manufacturer of the metal sheet used to form the substrate. In some instances, there are chemical pretreatments such as one or more pretreatment composition applied to the metal via, for example, spraying or dipping. For example, in some instances, the metal substrate is pretreated with a pretreatment composition comprising a zirconium compound and one or more polymers selected from polyester, acrylic, polyolefin, or combinations thereof. These pre-treatments may deposit one or more, often relatively thin layers on the metal substrate (e.g., less than 1 micron in thickness). Such layers may be organic, inorganic, or combinations of these. Such pre-treatment layers are considered to be part of the metal substrate. In some instances, the metal used to form the substrates herein are hexavalent chromium-free or so-called CFPA substrates (chromium-free-passivation alternative or electrolytic zirconium passivation (EZT) or trivalent chromium-coating technology (TCCT)) that include metal substrates substantially free, essentially free, or completely free of any pretreatments including hexavalent chromium (see, e.g., US 2022/0154360 A1 and patent references described therein, which are all incorporated herein by reference). CFPA metal substrates herein may be defined by DIN EN10202. Suitable pretreatments may be described in CA 2,166,331; U.S. Pat. Nos. 10,457,832; 5,427,632; or WO 9504169, which are all incorporated herein by reference.

The electrodeposition process of the compositions herein is generally known in the art. For instance, the beverage end coil substrate first passes over a charged roll (with either a positive or negative charge, and preferably a positive charge). The aqueous coating compositions herein are typically provided in a bath or tank that is grounded and contains electrodes charged in an opposite manner to that of the sheet such that when the sheet passes through the tank, an electrical potential will be established that permits the coating solids to be applied (viz., deposited) to one or both surfaces of the beverage end coil. As appreciated in the art, the coating solids can be applied to one or both sides (or alternatively varying coating weights to opposite sides) of the sheet depending on the electrode and voltage in the bath. In approaches, the polymers herein are configured to provide a bath conductivity of about 200 to about 3,000 micromhos, and, in other approaches, about 1,000 to 2,000 micromhos. For instance, at such conductivities, electrodepositing may be completed at about 25 to about 200 volts with a current draw of about 2 to about 10 amps per square foot of metal substrate surface area per mil of coating thickness. As also known in the art, the deposited coating thickness (as required by end use performance) is dependent, in part, on conductivity of the electrocoating polymer combined with a voltage and current draw. The electrodeposition solutions herein are preferably operated at temperatures of about 18° C. to 32° C.

Water-Dispersible Polyester Polymers

In preferred embodiments, the water-dispersible polyester polymers are functionalized polymers having backbones including ester linkages. In addition to ester linkages, such backbones may optionally include any combination of condensation and/or step growth linkages, including, for example, amide, carbonate ester, ester, ether, imide, urea, urethane, or combinations thereof. In preferred embodiments, the polymer has a polyester backbone that may optionally include any other suitable linkages. Thus, for example, in some embodiments, the polyester polymer may be a polyester-ether polymer (e.g., formed via reaction of a polyester prepolymer with a diepoxide such as, e.g., a diglycidyl ether). More preferably, the polyester backbone may be an aromatic polyester backbone. In some embodiments, the polyester backbone does not include any condensation linkages other than ester linkages. The water-dispersible polyester polymers herein are preferably functionalized with acid-functional pendant groups and, in approaches, are obtained from reactants including one or more polyacid monomers, one or more polyol monomers, one or more acid-functional unsaturated reactants (and/or one or more polyanhydride monomers), and wherein at least a portion of the acid-functional groups provided by the acid-functional ethylenically unsaturated reactants are neutralized with a base to provide the water-dispersibility.

In approaches, the one or more polyacid molecules or polycarboxylic acids suitable for preparing the water-dispersible polyester polymers herein include dicarboxylic acids, polycarboxylic acids having higher acid functionality (e.g., tricarboxylic acids, tetracarboxylic acids, and the like) or anhydrides thereof, precursors or derivatives thereof (e.g., an esterifiable derivative of a polycarboxylic acid, such as a dimethyl ester or anhydride), or mixtures thereof. Suitable polyacids or polycarboxylic acids may include, for example, maleic acid, fumaric acid, succinic acid, adipic acid, phthalic acid, tetrahydrophthalic acid, methyltetrahydrophthalic acid, hexahydrophthalic acid, methylhexahydrophthalic acid, endomethylenetetrahydrophthalic acid, azelaic acid, sebacic acid, isophthalic acid, trimellitic acid, terephthalic acid, naphthalene dicarboxylic acid, cyclohexane dicarboxylic acid, glutaric acid, nadic acid, dimer fatty acids, furan dicarboxylic acid (e.g., 2,5-furandicarboxylic acid), anhydrides or derivatives thereof (e.g., maleic anhydride), or mixtures thereof. If desired, adducts of polyacid compounds (e.g., triacids, tetraacids, and the like) and monofunctional compounds may be used. In some approaches, the water-dispersible polyester polymer, based on the weight of reactants used to form it, includes less than 10 wt-%, if any, of terephthalic acid (e.g., in embodiments in which the water-dispersible polyester includes at least 5 wt-% of furan dicarboxylic acid). It should be understood that in synthesizing the polyester, the specified acids may be in the form of anhydrides, esters (e.g., alkyl ester) or like equivalent form. For sake of brevity, such compounds are referred to herein as polyacids, carboxylic acids or polycarboxylic acids.

In approaches, the one or more polyol molecules may include diols, polyols having three or more hydroxyl groups (e.g., triols, tetraols, and the like), or combinations thereof. Suitable polyols may include, for example, ethylene glycol, propylene glycol, 1,3-propanediol, glycerol, butylene glycol, cyclohexane diol, cyclohexane dimethanol, hexane diol, diethylene glycol, dipropylene glycol, triethylene glycol, trimethylolpropane, trimethylolethane, tripropylene glycol, neopentyl glycol, pentaerythritol, 1,4-butanediol, hexylene glycol, cyclohexanedimethanol, 2-methyl-1,3-propane diol, 2-butyl-2-ethyl-1,3-propanediol, a polyethylene or polypropylene glycol, isopropylidene bis(p-phenylene-oxypropanol-2), 2,2,4,4-tetramethyl-1,3-cyclobutanediol, tricyclodecanedimethanol, 3,9-bis(1,1-dimethyl-2-hydroxyethyl)-2,4,8,10-tetraoxaspiro[5.5]undecane, or mixtures thereof. If desired, adducts of polyol compounds (e.g., triols, tetraols, and the like) and monofunctional compounds may be used. In some embodiments, the polyester polymer is not prepared from reactants including neopentyl glycol.

In some embodiments, it is preferable that the water-dispersible polyester polymer includes one or more aromatic groups, more preferably one or more backbone aromatic groups. Preferred aromatic polymers include at least about 5 weight percent (wt-%), more preferably at least about 10 wt-%, even more preferably at least about 15 wt-%, and even more preferably at least about 20 wt-% of aromatic groups. In some embodiments, the polymer may include up to 75 wt-% or more of aromatic groups. The aforementioned weight percentages correspond to the total weight of aromatic monomers used to form the polymer relative to the total weight of the reactants used to form polymer. Thus, for example, if an oligomer having an aromatic group is incorporated into the polymer, the wt-% of the aromatic group in the polymer is calculated using the weight of the aromatic monomer used to form the oligomer (as opposed to the weight of the oligomer). Suitable aromatic monomers include, for example, acid-, ester-, or anhydride-functional aromatic monomers (e.g., aromatic monoacids and/or polyacids, more preferably aromatic polyacids); hydroxyl-functional aromatic monomers (e.g., aromatic mono- and/or poly-functional monomers); or aromatic monomers having one or more (typically at least two) reactive groups capable of participating in a condensation and/or step-growth reaction with a complimentary reactive group (more preferably, a hydroxyl, carboxylic acid, ester, or anhydride groups) to form a covalent linkage. Examples of suitable aromatic monomers include terephthalic acid, isophthalic acid, phthalic acid, phthalic anhydride, trimellitic anhydride, trimellitic acid, dimethyl terephthalate, dimethyl isophthalate, dimethyl phthalate, 5-sodiosulpho isophthalic acid, naphthalic acid, 1,8-naphthalic anhydride, dimethyl naphthalate, pyromellitic dianhydride, 2,5-furandicraboxylic acid, and derivatives and combinations thereof.

In some embodiments, the one or more acid-functional unsaturated reactants for the polymers herein may include sorbic acid, maleic acid, fumaric acid, nadic acid, tetrahydrophthalic acid, anhydride derivatives thereof, or combinations thereof. As discussed more below, the one or more acid-functional unsaturated reactants preferably includes the combination of sorbic acid and maleic anhydride. For instance, the water-dispersible polyester polymer, in one embodiment, includes a structural unit in the polymer backbone derived from maleic anhydride (or another suitable unsaturated reactant such as, e.g., an unsaturated diol or diacid) and then the sorbic acid (or, e.g., another unsaturated mono-carboxylic acid) provides a pendant group to the polyester backbone attached to the maleic anhydride derived structural unit via a Diels-Alder reaction and/or a Ene reaction to provide the water-dispersibility functionality as discussed more below. In such structure, the water-dispersible polyester polymer may then include a cycloaliphatic group having at least one carbon-carbon double bond present in a ring of the cyclic group where the cycloaliphatic group may be derived from the maleic anhydride and sorbic acid reactants. An example of such a reaction and resulting structure is depicted later herein.

More specifically and, in some embodiments, the functionalized polyester polymers herein preferably include at least one functional group present in a pendant or side group that is attached to the backbone or another portion of the polymer (e.g., another portion attached to the backbone). In some embodiments, the side group constitutes an entire pendant group attached directly to the backbone, whereas in other embodiments the side group constitutes a portion of a pendant group and the side group itself is not directly attached to the backbone. In preferred embodiments, the functional-group-containing side group is attached to another portion of the polymer via one or more carbon-carbon bonds, more typically one or more carbon-carbon single bonds.

In some embodiments, a side group is located at one or both ends of the backbone. For example, one or both terminal ends of a preformed polymer may be modified to include a carbon-carbon double bond which is subsequently reacted with the unsaturated compound via a reaction disclosed herein to incorporate a functional-group-containing side group at one or both terminal ends of the backbone.

In preferred embodiments, the one or more functional-group-containing side groups are derived from an unsaturated compound, which typically includes one or more carbon-carbon double or triple bonds, more typically one or more carbon-carbon double bonds. A pericyclic reaction is preferably used to incorporate the unsaturated compound into the polymer or a precursor thereof. Suitable pericyclic reactions include Ene reactions and cycloaddition reactions. A Diels-Alder reaction is a preferred cycloaddition reaction. The resulting side group is typically unsaturated, although the side group may optionally be saturated.

While it is contemplated that polyester polymers of the present disclosure may include side groups that are free-radical-polymerized vinyl and/or acrylic groups, presently preferred side groups derived from the unsaturated compound are not free-radical-polymerized. Thus, preferred functional-group-containing side groups are incorporated into the polymer in a reaction that does not involve a free-radical initiator. Examples of free-radical-polymerized groups include vinyl groups (also sometimes referred to as "acrylic" groups when (meth)acrylates and/or (meth)acrylic acids are used) formed via free-radical-initiated reaction of ethylenically unsaturated monomers such as alkyl acrylates (e.g., ethyl acrylate, propyl acrylate, butyl acrylate, hydroxyl propyl acrylate, hydroxy butyl acrylate, glycidyl acrylate, etc.), alkyl methacrylates (e.g., ethyl methacrylate, methyl methacrylate, propyl methacrylate, butyl methacrylate, hydroxypropyl methacrylate, hydroxybutyl methacrylate, glycidyl methacrylate, etc.), acrylic acid, methacrylic acid, vinyl aromatics (e.g., styrene, vinyl toluene, etc.), vinyl chloride, acrylamides, methacrylamides, acrylonitriles, vinyl acetate, and the like, and combinations thereof. Examples of free-radical initiators include thermal free-radical initiators, photochemical free-radical initiators, and the like. Examples of thermal free-radical initiators include peroxide initiators, redox initiator systems, persulfate initiators, azoalkane initiators, and the like.

For example, and in some embodiments, acid-functional acrylic groups are sometimes incorporated into polymers such as polyester polymers to render the polymer dispersible in water (see, e.g., U.S. Pub. No 2005/0196629 for a discussion of such water-dispersible polyester-acrylic graft copolymers, which is incorporated herein by reference). The acid-functional acrylic groups are typically incorporated into the polymer via reaction with a carbon-carbon double bond of the polymer via a free-radical polymerization reaction involving initiator.

While certain Ene reactions may involve free-radical reactions, it should be noted that such reactions do not involve free-radical initiators such as are employed for free-radical-polymerized vinyl groups.

In some embodiments, the pendant or side group includes a functional group located at a terminal end of the side group away from the portion of the side group attached to the backbone or other portion of the polymer. A functional group of the side group may be attached to the backbone or other portion of the polymer via a branched or un-branched, saturated or unsaturated carbon chain that does not include any heteroatoms in the chain. An example of such a carbon chain is the structure $—(C(R^1)_m)_n—$, wherein: each $R^1$ is independently any suitable atom or group (e.g., a hydrogen atom, a halogen atom, an organic group, etc.); each m is independently 0, 1, or 2; n denotes an integer preferably from 1 to 20, more preferably from 1 to 10; and one or more $R^1$ may optionally join together with one or more other $R^1$ and/or with another portion or portions of the polymer.

In some embodiments, the side group does not include any repeat units. In preferred such embodiments, the side group is attached directly to the backbone, or a pendant group that is attached to the backbone, and is derived from a single molecule of the unsaturated compound (e.g., a single molecule of sorbic acid or the like). This approach can result in a functional-group-containing side group (e.g., when sorbic acid or the like is used as the unsaturated compound) that does not crosslink with double or triple bonds present in other polymer strands or free monomer. This is distinct, e.g., from the acrylate groups of polyester-acrylate copolymers.

The polyester polymer herein may have utility in a variety of end uses, including as an ingredient of a coating composition and, in particular, an aqueous coating composition suitable for electrodeposition to beverage end coil substrates. The polymer is particularly useful as a binder polymer of an adherent coating composition. Coating compositions of the present disclosure may optionally include one or more of additional ingredients such as, for example, a liquid carrier, a crosslinker, a pigment, a lubricant, a catalyst, etc. Typically, however, the coating composition is applied to a substrate with the assistance of a liquid carrier, which is preferably an aqueous coating composition that includes at least about 60 weight percent, based on total resin solids, of the polyester polymer herein (preferably, an aromatic polyester polymer) and less than about 1.2 kg/L of volatile organic solids, less than 1.0 kg/L of volatile organic content, less than about 0.8 kg/L of volatile organic content, less than about 0.5 kg/L of volatile organic content, less than about 0.4 kg/L of volatile organic content, or less than about 0.3 kg/L of volatile organic content.

An optional benefit of the method of the present disclosure is that it allows for the addition of one or more functional groups to a polymer at one or more "intermediate" locations (e.g., locations other than terminal backbone locations such as pendant locations) after the polymer has been formed or substantially formed, which can eliminate the need to use certain tri-functional or higher reactants to provide such functional groups. The use of certain tri-functional or higher reactants, such as, for example, reactants having three of more of the same type of active hydrogen group (e.g., triols or tricarboxylic acids), can lead to unsuitably high levels of branching, and even gelling, before the desired molecular weight and/or degree of functionalization is achieved. While it may be possible to use such tri-functional or higher reactants in relatively low concentrations while avoiding gellation of the sample, it may not be possible to achieve the desired molecular weight and degree of functionalization at such concentrations. Thus, in some embodiments, the method of the present disclosure enables the production of a substantially linear polymer having a molecular weight and a degree of functionalization that is not typically achievable using conventional condensation polymerization techniques-particularly when the desired functional groups are reactive with other functional groups present in the polymerization mixture. Examples of substantially linear polymers include polymers in which substantially all (e.g., >95 wt-%, >98 wt-%, >99 wt-%, >99.5 wt-%, etc.) of the monomers used to form the polymer are di-functional or mono-functional monomers. Accordingly, substantially linear polymers typically include less than 5 weight percent ("wt-%"), less than 2 wt-%, less than 1 wt-%, or less than 0.5 wt-% of tri-functional or higher monomers.

In preferred embodiments, the method of the present disclosure includes providing an unsaturated precursor polymer or prepolymer (typically a polyester polymer) having one or more double or triple bonds. Although branched materials may be used, the unsaturated polymer or prepolymer is typically linear or substantially linear. (For purposes of convenience, the unsaturated polymer or prepolymer thereof having one or more double or triple bonds will be referred to collectively hereinafter as the "unsaturated precursor polymer," or when used in the context of a polyester polymer, as the "unsaturated polyester precursor polymer.") While the one or more double or triple bonds of the unsaturated precursor polymer are typically located in a backbone of the polymer, the double or triple bonds may also be located in one or more pendant groups.

In optional embodiments, the unsaturated precursor polymer (typically a polyester) is preferably reacted with an unsaturated compound having the desired functionality. Typically, the reaction results in a thermal adduct of the unsaturated compound of the unsaturated precursor polymer, but it is also contemplated that other suitable reaction mechanisms may be used. In preferred embodiments, the reaction is performed at an elevated temperature such as, for example, from about 140° C. to about 220° C., more preferably from about 160° C. to about 200° C., and even more preferably from about 170° C. to about 190° C.

In embodiments, the unsaturated compound includes both: (i) one or more double bonds, more typically one or more carbon-carbon double bonds and (ii) one or more desired functional groups (which are typically groups other than double or triple bonds). Examples of suitable such functional groups may include active hydrogen groups having a hydrogen attached to, e.g., an oxygen (O), sulfur(S), and/or nitrogen (N) atom as, for example, in amine groups (e.g., =NH or —$NH_2$), aldehyde groups, anhydride groups, carboxylic groups (—COOH), hydroxyl groups (—OH), thiol groups (—SH); isocyanate (—NCO) or blocked isocyanate groups; ketone groups; any of the other functional groups described herein; or variants thereof (e.g., neutralized groups). In some embodiments, the functional group may be carbon-carbon double bonds.

As mentioned above, examples of suitable unsaturated compounds may include crotonic acid, furfuryl alcohol, furaldehyde, hydroxypropyl sorbate, sorbic acid, vinyl acetic acid and mixtures or derivates thereof. Additional examples of suitable unsaturated compounds may include: 2,4-hexadienoic acid (E)-1-trimethylsilyloxy-1,3-butadiene, (E)-2,4-pentadienoic acid, (E)-1-amino-1,3-butadiene, (E)-1-amido-1,3-butadiene, 2-trimethylsilyloxy-1,3-butadiene, (E)-1-methoxy-3-trimethylsilyloxy-1,3-butadiene, vinylnaphthalene, vinyldihydronaphthalene, vinylphenanthrene, vinylindole, vinylbenzofuran, vinylbenzothiophene, cyclohexa-2,4-dienone, o-benzoquinone, and mixtures thereof.

In some embodiments, salt or salt-forming groups are preferred functional groups for inclusion in the unsaturated compound. Acid or anhydride groups are particularly preferred in some embodiments.

In some embodiments, the unsaturated compound includes at least one allylic hydrogen, more preferably two allylic hydrogens attached to a same carbon atom. In an embodiment, the unsaturated compound has the structure (H) $(W^1)C—C(W^2)=C(W^3)$ $(W^4)$, wherein each of $W^1$ to $W^4$ is independently any suitable atom or group, with the proviso that at least one of $W^1$ to $W^4$ includes a functional group, more preferably a functional group disclosed herein. In preferred embodiments, $W^1$ is a hydrogen atom and at least one of $W^2$, $W^3$, or $W^4$ includes a functional group, more preferably a salt or salt-forming group.

The reaction between the unsaturated compound and the unsaturated precursor polymer typically consumes one or more double bonds and results in the formation of one or more covalent attachments between the unsaturated compound and the unsaturated precursor polymer. In some embodiments, the one or more covalent attachments are each carbon-carbon single bonds.

In certain embodiments, the unsaturated compound includes two or more conjugated carbon-carbon double bonds. By way of example, a compound having a —C(R)=C(R)—C(R)=C(R)— segment is a conjugated diene, where each R independently denotes any suitable atom (e.g., hydrogen, a halogen, etc.) or group. Examples of conjugated unsaturated compounds may include furfuryl alcohol, furaldehyde, hydroxypropyl sorbate, sorbic acid, and the like. In one approach, sorbic acid is a preferred conjugated unsaturated compound. By way of example, other suitable functionalized conjugated unsaturated compounds may include functionalized variants of any of the following: anthracene, butadiene (including, e.g., dimethyl butadiene), cyclohexadiene, cyclopentadiene (including, e.g., 1-alkyl cyclopentadienes or 2-alkyl cyclopentadienes), furan, isoprene, methyl vinyl ketone, thiophene, and mixtures thereof.

In embodiments, the unsaturated compound is reacted with the unsaturated precursor polymer (typically a polyester) to form a covalently attached side group derived from the unsaturated compound and having one or more functional groups. While not intending to be bound by any theory, it is believed that the unsaturated compound is covalently attached to the unsaturated precursor polymer via a reaction involving one or more double or triple bonds of the polymer to incorporate one or more side groups having the desired function group(s). In particular, it is believed that in preferred embodiments the reaction proceeds via a Diels-Alder reaction mechanism and/or an Ene reaction mechanism. Depending upon the materials used and the reaction conditions, it is believed that both Diels-Alder and Ene reactions can occur, which results in the incorporation of side groups having different structures. Diels-Alder and Ene reactions are both members of the "pericyclic" family of chemical reactions, although certain Ene reactions may be non-pericyclic reactions (e.g., certain Ene reactions in which a Lewis acid catalyst is used). It is also possible that one or more other pericyclic reactions may occur.

Diels-Alder reactions (often referred to as [4+2] cycloadditions) typically involve the addition of an unsaturated component (often referred to as a "dienophile" in the context of a Diels-Alder reaction) across the 1,4 position of a conjugated diene component to form a cycloaddition reaction product that is typically cyclic or bicyclic in nature. In some situations, at least one of the conjugated diene and unsaturated components contains one or more substituents that "activate" the component toward reaction, although in some instances one or both components can contain a "deactivating" substituent or substituents. The Diels-Alder reaction is generally considered to be a concerted reaction, and as such, either component can be the "electron donor" or "electron acceptor" depending upon the substituents bonded thereto. By way of example, a schematic diagram of the reaction mechanism thought to occur during a Diels-Alder reaction between sorbic acid and an unsaturated structural unit derived from maleic anhydride is depicted below, including the resulting functionalized side group. The below schematic diagram also provides an example of an unsaturated cycloaliphatic group present in certain pendant groups referenced herein.

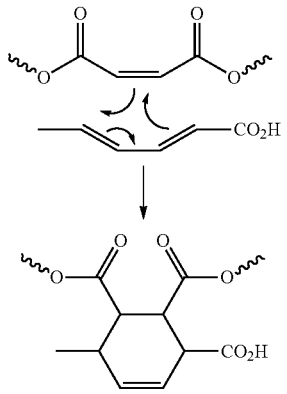

Thus, in some embodiments, the side group is attached to another portion of the functionalized polymer (e.g., a backbone of the polymer or another group attached to the backbone) via a cyclic group, which may optionally be a polycyclic group (e.g., a bridged bicyclic group such as a norbornene group). When a side group is attached via a Diels-Alder reaction mechanism, an unsaturated cyclic group is believed to result at the site of covalent attachment. The resulting unsaturated cyclic group may optionally be hydrogenated, if desired, to yield a saturated cyclic group In contrast, the reaction mechanism thought to occur if an Ene reaction occurs between sorbic acid and an unsaturated structural unit derived from maleic anhydride is depicted below, including the resulting functionalized side group.

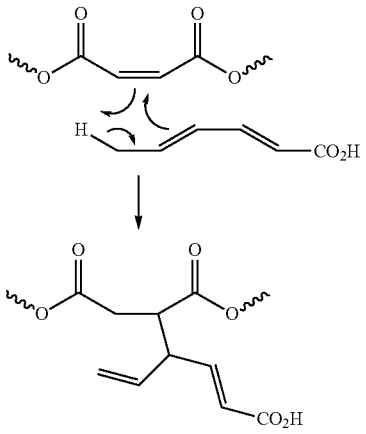

Unlike a Diels-Alder reaction mechanism, an Ene reaction mechanism does not require an unsaturated conjugated diene component. As such, when an Ene reaction mechanism is employed, a mono-unsaturated compound may be used (e.g., vinyl acetic acid) to incorporate a side group of the present disclosure. Ene reactions typically require that at least one allylic hydrogen is present, more preferably two allylic hydrogens are present which are attached to a same carbon atom. As depicted in the above reaction diagram, the covalently attached side group resulting from the Ene reaction is thought to include a double bond that includes a carbon atom to which an allylic hydrogen was attached prior to reaction.

In some embodiments, a Diels-Alder or Ene reaction mechanism may be used to covalently attach an unsaturated compound to an unsaturated pendant group of the unsaturated precursor polymer. In such embodiments, the resulting polymer includes at least one functional-group-containing side group that is not attached directly to a backbone of the polymer.

A Diels-Alder or Ene reaction may also be used to "endcap" one or more terminal ends of a backbone of the unsaturated precursor polymer with a structural unit derived from the unsaturated compound to provide one or more functional groups (e.g., carboxylic acid groups).

While any suitable double or triple bonds may be included in the unsaturated precursor polymer (when employed), carbon-carbon double bonds and carbon-carbon triple bonds are preferred, with carbon-carbon double bonds being presently preferred. If desired, the double bonds may be conjugated double bonds, more preferably conjugated carbon-carbon double bonds. The unsaturated precursor polymer can have any suitable backbone, including any type of polyester backbone previously described herein.

As discussed above, carbon-carbon double bonds are preferred for both the unsaturated compound and the unsaturated precursor polymer. Examples of other suitable double bonds may include carbon-oxygen double bonds, carbon-nitrogen double bonds, nitrogen-nitrogen double bonds, or nitrogen-oxygen double bonds. Preferred double bonds are capable of participating in one or both of a Diels-Alder reaction and an Ene reaction.

In another aspect, the present disclosure provides a water-dispersible polymer (preferably, a water-dispersible polyester polymer, and more preferably, a water-dispersible aromatic polyester polymer) having one or more water-dispersing groups, at least one of which has preferably been incorporated into the polymer using the functionalization methods of the present disclosure.

The water-dispersible polymer can include any suitable water-dispersing groups. In preferred embodiments, the water-dispersible polymer includes water-dispersing groups in the form of one or more salt groups such as, for example, anionic or cationic salt groups (e.g., neutralized acid or base groups), or a combination thereof.

Examples of suitable salt groups include anionic groups, cationic groups, and combinations thereof. Examples of anionic salt groups include neutralized acid or anhydride groups, sulphate groups ($—OSO_3^-$), phosphate groups ($—OPO_3^-$), sulfonate groups ($—SO_2O^-$), phosphinate groups ($—POO^-$), phosphonate groups ($—PO_3^-$), and combinations thereof. Examples of suitable cationic salt groups include: (referred to, respectively, as quaternary ammonium groups, quaternary phosphonium groups, and tertiary sulfate groups) and combinations thereof. Presently preferred salt groups include neutralized acid or anhydride groups and neutralized base groups, with neutralized carboxylic groups being preferred in certain embodiments.

In one approach or embodiment, non-limiting examples of neutralizing agents for forming anionic salt groups include inorganic and organic bases such as nitrogen-containing bases such amines, sodium hydroxide, potassium hydroxide, lithium hydroxide, ammonia, and mixtures thereof. In certain embodiments, tertiary amines are preferred neutralizing agents. Non-limiting examples of suitable tertiary amines include trimethyl amine, dimethylethanol amine (also known as dimethylamino ethanol), methyldiethanol amine, triethanol amine, ethyl methyl ethanol amine, dimethyl ethyl amine, dimethyl propyl amine, dimethyl 3-hydroxy-1-propyl amine, dimethylbenzyl amine, dimethyl 2-hydroxy-1-propyl amine, diethyl methyl amine, dimethyl 1-hydroxy-2-propyl amine, triethyl amine (TEA), tributyl amine, N-methyl morpholine, and mixtures thereof. Preferably, the neutralizing agent is triethyl amine (TEA).

In other approaches, examples of suitable neutralizing agents for forming cationic salt groups include organic and inorganic acids such as formic acid, acetic acid, hydrochloric acid, sulfuric acid, and combinations thereof.

In some embodiments, some or all of the salt groups of the water-dispersible polymer are provided using the functionalization method of the present disclosure and an unsaturated compound having: (i) one or more double bonds, more preferably one or more carbon-carbon double bonds and (ii) one or more salt or salt-forming groups (e.g., one or more carboxylic groups).

The incorporation of one or more water-dispersing groups into the polymer via reaction with the unsaturated compound can occur at any suitable time during the polymer synthesis. For example, a preformed unsaturated polymer of the desired molecular weight may be post-reacted with the unsaturated compound to provide the desired number of water-dispersing groups.

In other embodiments, an unsaturated prepolymer may be reacted with the unsaturated compound and the resulting functionalized prepolymer can be further upgraded to produce a functionalized polyester polymer having the desired final molecular weight. In certain such situations, however, care should be exercised to avoid gelling. For example, if the unsaturated compound is an acid-functional compound such as, for example, sorbic acid, and the prepolymer has acid and/or hydroxyl groups on each end, then the resulting prepolymer will have three or more acid and/or hydroxyl groups, which may lead to gelling problems if the prepolymer is reacted with additional polyfunctional compounds (e.g., diacids and/or diols) to further upgrade the molecular weight. Such potential gelling issues are absent when a preformed unsaturated polymer of the desired molecular weight is reacted with the unsaturated compound.

Any suitable unsaturated compound having a suitable salt or salt-forming group may be employed to form the water-dispersible polyester polymer. The unsaturated compound may include any suitable such groups described herein. Neutralizable acid or base groups are preferred salt-forming groups.

The unsaturated compound having one or more salt or salt-forming groups preferably includes at least one double bond capable of participating in a Diels-Alder reaction or an Ene reaction, with carbon-carbon double bonds being preferred. Conjugated double bonds are preferred in certain embodiments (e.g., where a Diels-Alder reaction is desired), with conjugated carbon-carbon double bonds being particularly preferred.

In embodiments in which an unsaturated compound having conjugated double bonds is used, the unsaturated polymer may include any suitable proportion of Ene incorporated or Diels-Alder incorporated side groups of the present disclosure. In some embodiments, both Ene and Diels-Alder reaction product side groups are present, with a substantial portion of the overall functional-group-containing side groups of the present disclosure incorporated via an Ene reaction (e.g., >10%, >25%, >50%, >60%, >70%, etc.). When both types of side groups are present, the Diels-Alder and Ene reaction product side groups can be present on same polymer strands, on different polymer strands, or a combination thereof.

While the salt-group-containing or salt-forming-group-containing unsaturated compound can be of any suitable atomic weight, in presently preferred embodiments, it has an atomic weight of less than about 200 Daltons (e.g., less than 200, less than 175, less than 150, less than 125, less than 100, etc.). While long-chain (e.g., >C12) and very-long chain (e.g., >C22) unsaturated fatty acids may be used, such unsaturated compounds are not presently preferred, especially if the polymer is to be used in certain food-contact packaging coating applications.

Examples of suitable unsaturated compounds having salt or salt-forming groups include sorbic acid (also referred to as 2,4-hexadienoic acid), 2,4-pentadienoic acid, furoic acid, 1-amino-1,3-butadiene, 1-naphthaleneacetic acid, anthracene carboxylic acid, 1,8-naphthalic anhydride, 1-naphthalene methylamine, vinyl acetic acid, neutralized variants thereof, and combinations thereof. Sorbic acid is a preferred unsaturated compound for use in forming the water-dispersible polymer.

The water-dispersible polymer can include any desired number of side group(s) derived from the unsaturated compound having one or more salt or salt-forming groups. In some embodiments, the water-dispersible polymer includes at least about 0.5% by weight, more preferably at least 1% by weight, and even more preferably at least about 2% by weight of such side groups. Although the maximum amount of such side groups is not restricted, the water-dispersible polymer will typically include side groups in an amount of less than about 50% by weight, more typically less than about 30% by weight, even more typically less than about 7% by weight. The above side group concentrations are based on the amount of unsaturated compound included in the reaction mixture relative to the total nonvolatile weight of reactants used to make the water-dispersible polymer.

The discussion that follows provides representative materials and methods for making water-dispersible polyester polymers of the present disclosure, as well as coating compositions formulated therefrom. The teachings of the below discussion may be applicable to other embodiments of the present disclosure as well.

The water-dispersible polyester polymer may include polymer segments other than polyester segments. Typically, however, at least 50 wt-% of the polyester will comprise polyester segments. In some embodiments, substantially all (e.g., >80 wt-%, >90 wt-%, >95 wt-%, etc.), or all, of the polyester on a weight basis comprises polyester segments.

The unsaturated polyester precursor polymer may be prepared using standard condensation reactions. The polyester precursor is typically derived from a mixture of at least one polyfunctional alcohol ("polyol") esterified with at least one polycarboxylic acid (or derivative thereof). The reaction mixture preferably includes at least one unsaturated reactant. In some embodiments, a transesterification polymerization may be used. If desired, the unsaturated polyester precursor polymer may include polymer linkages (e.g., amide, carbamate, carbonate ester, ether, urea, urethane, etc.), side chains, and end groups not related to simple polyol and polyacid components.

Any suitable unsaturated reactants may be used to incorporate double and/or triple bonds into the unsaturated polyester precursor polymer. Such unsaturated reactants will typically include at least one reactive functional group capable of participating in a condensation and/or step-growth polymerization, and more typically will include two or more such reactive functional groups, with two such functional groups being preferred in some embodiments. Examples of such reactive functional groups include any of the active hydrogen groups disclosed herein, as well as any other suitable reactive functional groups such as, for example, isocyanate (—NCO) groups. Reactive functional groups capable of participating in ester-forming reactions (e.g., hydroxyl groups, carboxylic groups, anhydride groups, etc.) are examples of preferred such reactive functional groups. Unsaturated polyacids, (poly) anhydrides, or esterified variants thereof are examples of preferred unsaturated reactants, with unsaturated dicarboxylic acids and unsaturated mono-anhydrides being presently preferred. Some specific examples of suitable unsaturated reactants may include unsaturated carboxylic acids such as maleic acid, 2-methyl maleic acid, fumaric acid, itaconic acid, 2-methyl itaconic acid, nadic acid, methyl-nadic acid, tetrahydrophthalic acid, methyltetrahydrophthalic acid, derivatives or anhydrides thereof (e.g., maleic anhydride, nadic anhydride, and the like), and mixtures thereof. Some specific examples of suitable unsaturated polyols may include butane diol, butyne diol, 3-hexyne-2,5-diol, 2-butynedioic acid, and mixtures thereof.

Maleic anhydride is an example of a preferred compound for incorporating unsaturation into the unsaturated polyester precursor polymer. Maleic anhydride is particularly useful for a variety of reasons, including, for example, cost and ready availability in commercial quantities. Moreover, while not intending to be bound by any theory, it is believed that maleic anhydride is a particularly strong dienophile having excellent reactivity in a Diels-Alder reaction. Maleic anhydride is also a preferred reactant for Ene reactions. It has been observed that Diels-Alder reactions can be conducted at a lower temperature for unsaturated polyester polymers having units derived from maleic anhydride (e.g., from about 150 to about 200° C. as opposed to, e.g., from 260 to 280° C. as may be required for polymers having units derived from unsaturated fatty acids or oils), which may be beneficial in certain embodiments in which a lower reaction temperature is desired.

In some embodiments (e.g., where the coating composition is intended for use as a food-contact coating composition), it is preferable that the ratio of functional-group-containing unsaturated compound (e.g., sorbic acid or the like) to unsaturation in the polyester precursor polymer be controlled to avoid the presence of unsuitable amounts of residual unreacted unsaturated compound in the coating composition. For example, when the unsaturation of the polyester precursor is provided by maleic anhydride (or some other such unsaturated reactant(s)), the polyester precursor polymer preferably includes an excess, on a molar basis, of units derived from maleic anhydride (or other unsaturated reactants) relative to the amount of functional-group-containing unsaturated compound (e.g., sorbic acid) included in the reaction mixture. More preferably, the molar ratio of functional-group-containing unsaturated compound to unsaturated monomeric units present in the polyester precursor is less than 0.8:1, and even more preferably less than 0.6:1. In some embodiments, the molar ratio of functional-group-containing unsaturated compound to unsaturated monomeric units present in the polyester precursor is greater than about 0.1:1, more preferably greater than about 0.2:1, and even more preferably greater than 0.3:1. In some embodiments, the molar ratio of functional-group-containing unsaturated compound to carbon-carbon double bond containing monomeric units present in the polyester precursor is as described above.

The water-dispersible polyester polymer may have any suitable end groups. In some embodiments, the backbone of the water-dispersible polyester polymer is hydroxyl-terminated and/or carboxyl-terminated, more preferably hydroxyl-terminated. The terminal hydroxyl groups may be primary hydroxyl groups, secondary hydroxyl groups, tertiary hydroxyl group or a combination thereof, although in certain embodiments primary hydroxyl groups may be preferred for purposes of enhanced reactivity with hydroxyl-reactive crosslinker.

When acid or anhydride groups are used to impart water-dispersibility to the polyester polymers herein, the acid- or anhydride-functional polymer preferably has an acid number of at least about 20, and more preferably at least about 22 milligrams (mg) KOH per gram resin. The acid- or anhydride-functional polyester polymer preferably has an acid number of no greater than about 35, and more preferably no greater than about 30 mg KOH per gram resin. The polymers herein may also have hydroxyl numbers of about 10 to about 20 mg KOH/gram of resin. Examples of useful test methods for determining each of the acid number and hydroxyl number of polyester polymers are provided in the Test Methods section of U.S. Pat. Publ. No. 2023/0092062.

In certain preferred embodiments, the water-dispersible polyester polymer is capable of being mixed with water to form a stable aqueous dispersion that does not separate into layers after being stored under normal conditions (e.g., storage in ambient temperature without agitation) for 1 week, preferably 1 month, and more preferably 3 months. The water-dispersible polyester polymers herein, and preferably the water dispersible aromatic polyester polymers herein, are configured for electrodeposition methods as discussed above.

The water-dispersible polyester polymers herein may have any suitable glass transition temperature ("Tg") for use as food or beverage container coatings. In some embodiments (e.g., for use on beverage end metal substrate), the polymer has a Tg of at least about 25° C., in other approaches at least about 30° C., and in yet other approaches at least about 40° C. Although the maximum Tg is not particularly restricted, preferably the Tg is less than about 100° C., in other approaches less than about 80° C., and in yet further approaches less than about 60° C. As noted above, Tg is measured via DSC.

The water-dispersible polyester polymer may be of any suitable molecular weight. In preferred embodiments, the water-dispersible polyester polymer has a number average molecular weight (Mn) as determined via gel permeation chromatography (GPC) using polystyrene standards of at least about 2,000, more preferably at least about 3,000, and even more preferably at least 4,000. While the upper molecular weight range is not restricted, the water-dispersible polyester polymer will typically have an Mn of less than about 50,000, more typically less than about 20,000, even more typically less than about 10,000. In approaches, the number average molecular weight may be about 2,500 to about 10,000, preferably about 3,000 to about 8,000, and more preferably about 4,000 to about 6,000. As noted above, molecular weight is determined by GPC using polystyrene as a reference.

In some embodiments, the water-dispersible polyester polymer is preferably free or appreciably free of fatty acids (e.g., long-chain or very long-chain fatty acids), oils, and/or other long-chain hydrocarbons. It is believed that the use of unsuitable amounts of such materials may impart undesirable off-tastes or odors to packaged food or beverage products that are kept in prolonged contact with the coating compositions of the present disclosure. When used in interior beer can coatings, the presence of unsuitable amounts of such materials in the polymer may diminish the "head" on the beer product. In addition, the presence of unsuitable amounts of such materials in the polymer may cause the corrosion resistance of coating compositions of the present disclosure to be unsuitable for certain end uses, especially for packaging coatings intended for use with so called "hard-to-hold" food or beverage products. In certain preferred embodiments, the water-dispersible polyester polymer includes no more than 10 wt-%, more preferably no more than 3 wt-%, and even more preferably no more than 1 wt-% of fatty acids, oils, or other "long-chain" hydrocarbons (e.g., having 8 or more carbon atoms such as ≥C10, ≥C12, ≥C15, ≥C20, ≥C30), based on the total non-volatile weight of the reactants used to make the water-dispersible polyester polymer.

It is contemplated that, in certain embodiments, the water-dispersible polyester polymer may include some long-chain hydrocarbons having 12 or less carbon atoms such as, for example, sebacic acid.

In certain preferred embodiments, the water-dispersible polyester polymer is not an alkyd resin.

Similarly, presently preferred coating compositions of the present disclosure are preferably free, or appreciably free, of fatty acids (e.g., long-chain or very long-chain fatty acids) and oils. Preferred coating compositions include no more than 20 wt-%, more preferably no more than 10 wt-%, and even more preferably no more than 5 wt-% of oils and fatty acids, based on the total nonvolatile weight of the coating composition.

The water-dispersible polyester polymer may have utility in a variety of different coating end uses. It has been discovered that the water-dispersible polyester polymer is particularly useful in packaging coating applications, including food or beverage container applications and, as noted above, for use in electrodeposition coating processes, and especially electrodeposition coating processes for beverage can end coil substrate. The discussion that follows pertains to coating compositions formulated using the water-dispersible polyester polymer and having utility in packaging coating end uses. While the discussion that follows focuses on packaging coating compositions, it is within the scope of the present disclosure to apply the teachings to coating compositions intended for other end uses.

In various approaches or embodiments, coating compositions (or concentrates suitable to form the coating compositions) of the present disclosure may include any suitable amount of the water-dispersible polyester polymer to produce the desired result. Preferred coating compositions (or concentrates) include at least about 50 wt-%, more preferably at least about 60 wt-%, and even more preferably at least about 70 wt-% of the water-dispersible polyester polymer. Preferred coating compositions (or concentrates) include up to about 100 wt-%, more preferably up to about 95 wt-%, and even more preferably up to about 80 wt-% of the water-dispersible polyester polymer. These weight percentages are based on the total weight of resin solids present in the coating composition. While the total amount of resins solids in the coating composition may vary greatly depending on the particular embodiment and may be any suitable amount, resin solids will typically constitute at least a majority of the total nonvolatile weight of the coating composition.

Crosslinker:

The coating composition (or concentrate) preferably further comprises a crosslinking resin. For example, any of the well-known hydroxyl-reactive and/or carboxyl-reactive curing resins can be used. The choice of particular crosslinker typically depends on the particular product being formulated. Examples of suitable crosslinkers include aminoplasts, phenoplasts, blocked isocyanates, beta-hydroxyalkyl amides, benzoxazines, carbonyl dicaprolactams, oxazolines, and combinations thereof.

Phenoplast resins include the condensation products of aldehydes with phenols. Formaldehyde and acetaldehyde are preferred aldehydes. Various phenols can be employed such as, for example, phenol, cresol, p-phenylphenol, p-tert-butylphenol, p-tert-amylphenol, and cyclopentylphenol.

Aminoplast resins include, for example, the condensation products of aldehydes such as formaldehyde, acetaldehyde, crotonaldehyde, and benzaldehyde with amino- or amido-group-containing substances such as urea, melamine, and benzoguanamine. Examples of suitable aminoplast resins include benzoguanamine-formaldehyde resins, melamine-formaldehyde resins, esterified melamine-formaldehyde, urea-formaldehyde resins, and combinations thereof.

Condensation products of other amines and amides can also be employed such as, for example, aldehyde condensates of triazines, diazines, triazoles, guanadines, guanamines and alkyl- and aryl-substituted melamines. Some examples of such compounds are N,N'-dimethyl urea, benzourea, dicyandimide, formaguanamine, acetoguanamine, glycoluril, ammelin 2-chloro-4,6-diamino-1,3,5-triazine, 6-methyl-2,4-diamino-1,3,5-triazine, 3,5-diaminotriazole, triaminopyrimidine, 2-mercapto-4,6-diaminopyrimidine, 3,4,6-tris(ethylamino)-1,3,5-triazine, and the like. While the aldehyde employed is typically formaldehyde, other similar condensation products can be made from other aldehydes, such as acetaldehyde, crotonaldehyde, acrolein, benzaldehyde, furfural, glyoxal and the like, and mixtures thereof.

Examples of suitable isocyanate crosslinkers include blocked or non-blocked aliphatic, cycloaliphatic or aromatic di-, tri-, or poly-valent isocyanates, such as hexamethylene diisocyanate (HMDI), cyclohexyl-1,4-diisocyanate and the like, and mixtures thereof. Examples of generally suitable isocyanates for use in such crosslinkers include isomers of isophorone diisocyanate, dicyclohexylmethane diisocyanate, toluene diisocyanate, diphenylmethane diisocyanate, phenylene diisocyanate, tetramethyl xylene diisocyanate, xylylene diisocyanate, and mixtures thereof. In presently preferred embodiments, the coating composition is not formulated using an isocyanate crosslinkers.

Other suitable crosslinkers include those described in U.S. Pat. Pub. No. 2016/0297994 (Kuo et al.) such as benzoxazine-based phenolic resins, U.S. Pat. Pub. No. 2016/0115347 (Kuo et al.) such as resole curable phenolic resins based on meta-substituted phenol, U.S. Pat. No. 9,598,602 (Kuo et al.) such as a phenolic resin substituted with at least one methylol group, U.S. Pub. No. 2016/0115345 (Kuo et al.) such as a resole phenolic resin containing the residues of an unsubstituted phenol and/or meta-substituted phenol), and U.S. Pat. Pub. No. 2017/0327272 (Chasser et al.) such as a polycarbodiimide. Other suitable crosslinkers include alkanolamide-type curing agents such as beta-hydroxyalkylamide crosslinkers available under the trade names PRIMID XL-552 and PRIMID QM-1260 from EMS-CHEMIE AG.

The level of curing agent used will depend, for example, on the type of curing agent, the time and temperature of the bake, and the molecular weight of the polymer. When used, the crosslinker is typically present in an amount ranging from about 5 to about 40% by weight. Preferably, the crosslinker is present in an amount ranging from between 10 to 30% by weight; and more preferably, from 15 to 25% by weight. These weight percentages are based upon the total weight of the resin solids in the coating composition.

Optional Ingredients:

The coating composition (or concentrate) of the present disclosure may also include other optional ingredients that do not adversely affect the coating composition or a cured coating composition resulting therefrom. Such optional ingredients are typically included in a coating composition to enhance composition esthetics, to facilitate manufacturing, processing, handling, and application of the composition, and to further improve a particular functional property of a coating composition or a cured coating composition resulting therefrom.

Such optional ingredients include, for example, catalysts, dyes, pigments, toners, extenders, fillers, lubricants, anticorrosion agents, flow control agents, thixotropic agents, dispersing agents, antioxidants, adhesion promoters, light stabilizers, organic solvents, and mixtures thereof. Each optional ingredient is included in a sufficient amount to serve its intended purpose, but not in such an amount to adversely affect a coating composition or a cured coating composition resulting therefrom.

One optional ingredient is a catalyst to increase the rate of cure and/or the extent of crosslinking. Non-limiting examples of catalysts, include, but are not limited to, strong acids (e.g., dodecylbenzene sulphonic acid (DDBSA, available as CYCAT 600 from Cytec), methane sulfonic acid (MSA), p-toluene sulfonic acid (pTSA), dinonylnaphthalene disulfonic acid (DNNDSA), and triflic acid), quaternary ammonium compounds, phosphorous compounds, tin and zinc compounds, and combinations thereof. Examples include a tetraalkyl ammonium halide, a tetraalkyl or tetraaryl phosphonium iodide or acetate, tin octoate, zinc octoate, triphenylphosphine, and similar catalysts known to persons skilled in the art. If used, a catalyst is preferably present in an amount of at least 0.01 wt-%, and more preferably at least 0.1 wt-%, based on the weight of nonvolatile material in the coating composition. If used, a catalyst is preferably present in an amount of no greater than 3 wt-%, and more preferably no greater than 1 wt-%, based on the weight of nonvolatile material in the coating composition.

Another useful optional ingredient is a lubricant, like a wax, which facilitates manufacture of coated articles (e.g., food or beverage can ends) by imparting lubricity to planar coated metal substrate. A lubricant is preferably present in the coating composition in an amount of about 0.1% to about 5%, and preferably about 0.3% to about 3.5%, by weight of nonvolatile material. Preferred lubricants include, for example, Carnauba wax, polyethylene-type lubricants, polytetrofluoroethylene (PTFE)-modified polyethylene lubricants, and Fisher-Tropsch lubricants. In certain preferred embodiments, a lubricant is used that does not contain fluorine atoms and the coating composition is free of fluorine-containing lubricants.

Another useful optional ingredient is a pigment, like titanium dioxide. A pigment is optionally present in the coating composition in an amount of 0 to about 50%, by weight of nonvolatile material.

In certain preferred embodiments, the coating composition (or concentrate) is a water-based coating composition that preferably includes at least a film-forming amount of the water-dispersible polyester polymer of the present disclosure. The coating composition preferably includes at least 30 wt-% of liquid carrier and more typically at least 50 wt-% of liquid carrier. In such embodiments, the coating composition will typically include less than 90 wt-% of liquid carrier, more typically less 80 wt-% of liquid carrier. The liquid carrier is preferably at least about 75 wt-% water, more preferably at least about 90 wt-% water, and even more preferably at least of about 95 wt-% water. In some embodiments, the liquid carrier is free or substantially free of organic solvent.

In certain preferred embodiments, the water-based coating composition (or concentrate) is storage stable (e.g., does not separate into layers) under normal storage conditions for at least 1 week, more preferably at least 1 month, and even more preferably at least 3 months.

In some embodiments, the cured coating composition of the present disclosure preferably has a Tg of at least 20° C., more preferably at least 25° C., and even more preferably at least 30° C. In some embodiments, the Tg of the cured coating composition is preferably less than about 80° C., more preferably less than about 70° C., and even more preferably less than about 60° C.

Preferred coating compositions (or concentrates) are substantially free of bisphenol A ("BPA") and the diglycidyl ether of BPA ("BADGE"), and more preferably essentially free of these compounds, and most preferably completely free of these compounds. In addition, preferred compositions are also substantially free, more preferably essentially free, and most preferably completely free of each of: bisphenol S, bisphenol F, and the diglycidyl ether of bisphenol F or bisphenol S. In some embodiments, the concentrate and/or coating composition of the present disclosure are substantially free, essentially free, or completely free of each of bisphenols.

In some embodiments, the polymer of the present disclosure (and preferably the coating composition or concentrate) is at least substantially "epoxy-free," more preferably "epoxy-free." The term "epoxy-free," when used herein in the context of a polymer, refers to a polymer that does not include any "epoxy backbone segments" (i.e., segments formed from reaction of an epoxy group and a group reactive with an epoxy group). Thus, for example, a polymer having backbone segments that are the reaction product of a bisphenol (e.g., bisphenol A, bisphenol F, bisphenol S, 4,4'dihydroxy bisphenol, etc.) and a halohdyrin (e.g., epichlorohydrin) would not be considered epoxy-free. However, a vinyl polymer formed from vinyl monomers and/or oligomers that include an epoxy moiety (e.g., glycidyl methacrylate) would be considered epoxy-free because the vinyl polymer would be free of epoxy backbone segments.

Also, it is desirable to avoid the use of components that are unsuitable for such surfaces due to factors such as taste, toxicity, or other government regulatory requirements.

For example, in preferred embodiments, the concentrate and the coating composition are each "PVC-free." That is, the compositions preferably contain, if any, less than 2% by weight of vinyl chloride materials and other halogenated vinyl materials, more preferably less than 0.5% by weight of vinyl chloride materials and other halogenated vinyl materials, and even more preferably less than 1 ppm of vinyl chloride materials and other halogenated vinyl materials, if any.

As a general guide to minimize potential, e.g., taste and toxicity concerns, a cured coating formed from the coating composition preferably includes, if it includes any detectable amount, less than 50 ppm, less than 25 ppm, less than 10 ppm, or less than 1 ppm, extractables, when tested pursuant to the Global Extraction Test described in the Test Methods Section.

Such reduced global extraction values may be obtained by limiting the amount of mobile or potentially mobile species in the cured coating. In this context, "mobile" refers to material that may be extracted from a cured coating according to the Global Extraction Test of the Test Methods Section. This can be accomplished, for example, by using pure, rather than impure reactants, avoiding the use of hydrolyzable components or bonds, avoiding or limiting the use of low molecular weight additives that may not efficiently react into the coating, and using optimized cure conditions optionally in combination with one or more cure additives. This makes the cured coatings formed from the coating compositions described herein particularly desirable for use on food-contact surfaces.

Coating compositions (or concentrates) of the present disclosure may be prepared by conventional methods in various ways. For example, the coating compositions may be prepared by simply admixing the polymer, optional crosslinker and any other optional ingredients, in any desired order, with sufficient agitation. The resulting mixture may be admixed until all the composition ingredients are substantially homogeneously blended. Alternatively, the coating compositions may be prepared as a liquid solution or dispersion by admixing an optional carrier liquid, polyester polymer, optional crosslinker, and any other optional ingredients, in any desired order, with sufficient agitation. An additional amount of carrier liquid may be added to the coating compositions to adjust the amount of nonvolatile material in the coating composition to a desired level.

In some embodiments, the polyester polymer is polymerized in organic solvent and base or acid groups present on the polyester polymer are at least partially neutralized to disperse the polymer into aqueous medium to form a stable aqueous dispersion for further formulation. In one approach or embodiment, the organic solvent is an organic solvent that is not designated as an Hazardous Air Pollutant (e.g., a toxic air pollutant). Suitable organic solvents that are not considered a HAP include butyl cellosolve (e.g., 2-butoxyethanol), methyl amyl ketone, or combinations thereof.

Cured coatings of the present disclosure preferably adhere well to metal (e.g., steel, tin-free steel (TFS), tin plate, electrolytic tin plate (ETP), aluminum, etc.) and provide high levels of resistance to corrosion or degradation that may be caused by prolonged exposure to products such as food or beverage products. The coatings may be applied to any suitable surface, including inside surfaces of containers, outside surfaces of containers, container ends, and combinations thereof.

The coating composition of the present disclosure can be applied to a substrate using any suitable procedure such as electrodepositing, spray coating, roll coating, coil coating, curtain coating, immersion coating, meniscus coating, kiss coating, blade coating, knife coating, dip coating, slot coating, slide coating, and the like, as well as other types of premetered coating. In an embodiment where the coating is used to coat metal sheets or coils, the coating can be applied by roll coating. As noted above, the coating compositions herein are particularly suited for electrodepositing and low VOC electrodepositing coating methods.

In approaches, the polymers of the present disclosure may be provided in a concentrate having, based on total solids, at least about 60 weight percent of the water-dispersible polymers herein, preferably at least about 70 weight percent of the water dispersible polymers herein. In one approach, the concentrate has about 20 to about 30 weight percent total solids and wherein the concentrate is diluted to about 5 to about 15 weight percent total solids for the aqueous electrodeposition coating compositions herein. Dilution may be via water so long as the aqueous electrodeposition coating compositions herein have the noted VOC contents discussed above.

After applying the coating composition onto a substrate, the composition can be cured using a variety of processes, including, for example, oven baking by either conventional or conventional methods. The curing process may be performed in either discrete or combined steps. For example, the coated substrate can be dried at ambient temperature to leave the coating composition in a largely un-crosslinked state. The coated substrate can then be heated to fully cure the coating composition. In certain instances, the coating composition can be dried and cured in one step. In preferred embodiments, the coating composition of the present disclosure is a heat-curable thermoset coating composition.

The coating composition of the present disclosure may be applied, for example, as a mono-coat direct to metal (or direct to pretreated metal), as a primer coat, as an intermediate coat, as a topcoat, or any combination thereof.

Preferred coating compositions (or concentrates) of the present disclosure formulated using the water-dispersible polyester polymer are particularly useful as adherent coatings on interior or exterior surfaces of metal packaging containers. Non-limiting examples of such articles include closures (including, e.g., internal surfaces of twist-off caps for food and beverage containers); internal crowns; two and three-piece metal cans (including, e.g., food and beverage cans); shallow drawn cans; deep drawn cans (including, e.g., multi-stage draw and redraw food cans); can ends (including, e.g., riveted beverage can ends and easy open can ends); monobloc aerosol containers; and general industrial containers, cans, and can ends; and drug cans such as metered-dose-inhaled ("MDI") cans.

The aforementioned coating compositions formulated using the water-dispersible polyester polymers are particularly well adapted for use as a coating for two-piece cans, including two-piece cans having a riveted can end for attached a pull tab thereto. Two-piece cans are manufactured by joining a can body (typically a drawn metal body) with a can end (typically a drawn metal end). In preferred embodiments, the coating compositions are suitable for use in food-contact situations and may be used on the inside of such cans. The coatings are also suited for use on the exterior of the cans. Notably, the coatings are well adapted for use in a coil coating operation. In this operation, a coil of a suitable substrate (e.g., aluminum or steel sheet metal) is first coated with the coating composition (on one or both sides preferably with electrodeposition), cured (e.g., using a bake process), and then the cured substrate is formed (e.g., by stamping or drawing) into the can end or can body or both. The can end and can body are then sealed together with a food or beverage contained therein. Such coating compositions are particularly well adapted for use as an internal or external coating on a riveted beverage can end (e.g., a beer or soda can end). Preferred embodiments exhibit an excellent balance of corrosion resistance and fabrication properties (including on the harsh contours of the interior surface of the rivet to which the pull tab attaches) when applied to metal coil that is subsequently fabricated into a riveted beverage can end.

In other embodiments, the present disclosure also provides methods that include "causing" any embodiment of the food or beverage coating compositions herein to be used on a metal substrate (or portion thereof) of a metal food or beverage container or packaging. In some cases, where multiple parties are involved, a first party (e.g., the party that manufactures and/or supplies the food or beverage container coating composition) may provide instructions, recommendations, or other disclosures about the food or beverage container coating composition end use to a second party (e.g., a metal coater (e.g., a coil coater for beverage can ends), can maker, or brand owner). Such disclosures may include, for example, instructions, recommendations, or other disclosures relating to coating a metal substrate for subsequent use in forming packaging containers or portions thereof, coating a metal substrate of pre-formed containers or portions thereof, preparing powder coating compositions for such uses, cure conditions or process-related conditions for such coatings, or suitable types of packaged products for use with resulting coatings. Such disclosures may occur, for example, in technical data sheets (TDSs), safety data sheets (SDSs), regulatory disclosures, warranties or warranty limitation statements, marketing literature or presentations, or on company websites. A first party making such disclosures to a second party shall be deemed to have "caused" any embodiment of the coating compositions herein to be used on a metal substrate of metal packaging (e.g., a container or closure) even if it is the second party that actually applies the composition to a metal substrate in commerce, uses such coated substrate in commerce on a metal substrate of packaging containers, and/or fills such coated containers with product.

Test Methods

Unless otherwise specified, below are some test methods useful for assessing the coating properties of certain embodiments of the coating compositions of the present disclosure.

Global Extraction Test

The global extraction test is designed to estimate the total amount of mobile material that can potentially migrate out of a coating and into food or beverage packed in a coated can. Typically, a coated substrate is subjected to water or solvent blends under a variety of conditions to simulate a given end-use.

Acceptable extraction conditions and media can be found in 21 CFR § 175.300, paragraphs (d) and (e). The extraction procedure used in the current disclosure is conducted in accordance with the Food and Drug Administration (FDA) "Preparation of Premarket Submission for Food Contact Substances: Chemistry Recommendations," (December 2007). The allowable global extraction limit as defined by the FDA regulation is 50 parts per million (ppm).

The single-sided extraction cells are made according to the design found in the Journal of the Association of Official Analytical Chemists, 47 (2): 387 (1964), with minor modifications. The cell is 9 in (inches)×9 in ×0.5 in with a 6 in ×6 in open area in the center of the TEFLON spacer. This allows for 36 $in^2$ or 72 $in^2$ of test article to be exposed to the food simulating solvent. The cell holds 300 mL of food simulating solvent. The ratio of solvent to surface area is then 8.33 mL/$in^2$ and 4.16 mL/$in^2$ when 36 $in^2$ and 72 $in^2$ respectively of test article are exposed.

Two coated test articles (e.g., aluminum beverage coil e-coated with the coating composition of the present disclosure) are used per cell for a total surface area of 72 $in^2$ per cell. The test articles are extracted in quadruplicate using 10% aqueous ethanol as the food-simulating solvent. The test articles are processed at 121° C. for two hours, and then stored at 40° C. for 238 hours. The test solutions are sampled after 2, 24, 96 and 240 hours. The test article is extracted in quadruplicate using the 10% aqueous ethanol under the conditions listed above.

Each test solution is evaporated to dryness in a preweighed 50 mL beaker by heating on a hot plate. Each beaker is dried in a 250° F. (121° C.) oven for a minimum of 30 minutes. The beakers are then placed into a desiccator to cool and then weighed to a constant weight. Constant weight is defined as three successive weighings that differ by no more than 0.00005 grams.

Solvent blanks using Teflon sheet in extraction cells are similarly exposed to simulant and evaporated to constant weight to correct the test article extractive residue weights for extractive residue added by the solvent itself. Two solvent blanks are extracted at each time point and the average weight is used for correction.

Total nonvolatile extractives are calculated as follows: Ex=e/s; where Ex=Extractive residues (mg/$in^2$), e=Extractives per replicate tested (mg), and s=area extracted ($in^2$).

Preferred coatings give global extraction results of less than 50 ppm, more preferred results of less than 10 ppm, even more preferred results of less than 1 ppm. Most preferably, the global extraction results are optimally non-detectable.

Adhesion Test

Adhesion testing is performed to assess whether the coating adheres to the coated substrate. The adhesion test was performed according to ASTM D 3359-Test Method B, using SCOTCH 610 tape, available from 3M Company of Saint Paul, Minnesota. Adhesion is generally rated on a scale of 0-10 where a rating of "10" indicates no adhesion failure, a rating of "9" indicates 90% of the coating remains adhered, a rating of "8" indicates 80% of the coating remains adhered, and so on. Adhesion ratings of 10 are typically desired for commercially viable coatings.

Blush Resistance Test

Blush resistance measures the ability of a coating to resist attack by various solutions. Typically, blush is measured by the amount of water absorbed into a coated film. When the film absorbs water, it generally becomes cloudy or looks white. Blush is generally measured visually using a scale of 0-10 where a rating of "10" indicates no blush and a rating of "0" indicates complete whitening of the film. Blush ratings of at least 7 are typically desired for commercially viable coatings and optimally 9 or above.

Water Pasteurization Test

This is a measure of the coating integrity of the coated substrate after exposure to heat while in contact with water. This test provides an indication of an ability of a coating to withstand conditions frequently associated with food or beverage preservation or sterilization. For the present evaluation, coated substrate samples (in the form of flat panels) were placed in a vessel and partially immersed in DI water. Testing is accomplished by subjecting the immersed coated substrate to heat of 82.2° C. at atmospheric pressure for a period of 45 minutes. The coated substrate was then tested for adhesion and blush as described above. In food or beverage applications requiring water pasteurization performance, adhesion ratings of 10 and blush ratings of at least 7 are typically desired for commercially viable coatings.

Fabrication Test

This test provides an indication of the level of flexibility of a coating. Moreover, this test measures the ability of a coating to retain its integrity as it undergoes the formation process necessary to produce a food or beverage can end. In particular, it is a measure of the presence or absence of cracks or fractures in the formed end. To be suitable for food or beverage can end applications, a coating composition should preferably exhibit sufficient flexibility to accommodate the extreme contour of the rivet portion of the easy open food or beverage can end.

The end is typically placed on a cup filled with an electrolyte solution. The cup is inverted to expose the surface of the end to the electrolyte solution. The amount of electrical current that passes through the end is then measured. If the coating remains intact (no cracks or fractures) after fabrication, minimal current will pass through the end.

For the present evaluation, fully converted 202 standard opening riveted beverage can ends were exposed for a period of 4 seconds to an electrolyte solution comprised of 1% NaCl by weight in deionized water. Metal exposures were measured using a WACO Enamel Rater II, available from the Wilkens-Anderson Company, Chicago, Illinois, with an output voltage of 6.3 volts. The measured electrical current, in milliamps, is reported. End continuities are typically tested initially and then after the ends are subjected to pasteurization.

Solvent Resistance Test

The extent of "cure" or crosslinking of a coating is measured as a resistance to solvents such as methyl ethyl ketone (MEK). This test is performed as described in ASTM D 5402-93. The number of double rubs (i.e., one back-and-forth motion) is reported. Preferably, the MEK solvent resistance is at least 30 double rubs.

Feathering Test

To test feathering, a suitably sized tab (e.g., of a similar size to a soda can opening) is scored on the backside of a coated metal panel, with the coated side of the panel facing downward. The test piece is then immersed in a deionized water bath for 45 minutes at 85° C. After pasteurization, pliers are used to bend the cut tab to a 90-degree angle away from the coated side of the substrate. The test piece is then placed on a flat surface, coated side down. The cut tab is gripped using pliers and the tab is pulled from the test panel at an angle of 180 degrees until it is completely removed to create an opening. After removing the tab, any coating that extends into the opening on the test panel is measured. The largest distance that the coating extends into the opening is measured (feathering) and reported in inches. Coatings for easy-open food or beverage can ends preferably show feathering below 0.2 inches (0.508 cm), more preferably below 0.1 inches (0.254 cm), most preferably below 0.05 inches (0.127 cm), and optimally 0.02 inches or lower (0.051 cm). Preferred beverage can end coatings of the present disclosure exhibit feathering properties pursuant to the values provided above.

Acid Number (AN)

The acid number (AN) of a polymer or resin may be measured by dissolving a suitable quantity of the resin in a solution of dimethyl formamide (DMF) and methyl ethyl ketone (MEK), then titrating with 0.1 N methanolic KOH and a cresol red/thymol blue or phenolphthalein indicator. Based on the amount of KOH consumed, the acid number is calculated and reported as mg KOH per 1 gram of dry resin.

Hydroxyl Number

The hydroxyl value (HN) of a polymer or resin may be measured by dissolving a suitable quantity of the resin in Methylene Chloride before mixing the sample for 15-20 minutes with a 4-(dimethylamino) pyridine (DMAP) catalyst solution and a 97% acetic anhydride solution in anhydrous dimethyl formamide (DMF). A solution of DMF and deionized water is then added and the solution is mixed for an additional 15-20 minutes. After supplemental addition of tetrahydrofuran (THF), a titration method with 0.5 N methanolic KOH and a phenolphthalein indicator is used to measure the hydroxyl value of a resin. Based on the amount of KOH consumed as compared to titration of a solution without the resin, the hydroxyl value is calculated and reported as mg KOH per 1 g dry resin.

EXAMPLES

The disclosure is illustrated by the following examples. It is to be understood that the particular examples, materials, amounts, and procedures are to be interpreted broadly in accordance with the scope and spirit of the disclosures as set forth herein. Unless otherwise indicated, all parts, percentages, and ratios are by weight and all molecular weights are weight average molecular weight. Unless otherwise specified, all chemicals used are commercially available from, for example, Sigma-Aldrich, St. Louis, Missouri.

Example 1

Preparation of a water dispersible polyester polymer: The following reactants were charged to a 5 liter flask equipped with a stirrer, gas inlet, packed column, condenser, thermocouple, and heat source: 383.31 grams (g) Teraphthalic acid; 128.61 g Isophthalic acid; 294.00 g 2-methyl-1,3 propanediol; and 108.90 g 2-butyl-2-ethyl-1,3 propanediol. Next, 0.91 grams of Fascat 4100 catalyst (commercially available from PMC Organometallix Inc.) was added under agitation and the materials were gradually heated under nitrogen to about 240° C. over the course of about 70 minutes. The reaction was held at this temperature until an acid value below 8.0 mg KOH/g resin was achieved. Approximately 121 milliliters of water were distilled out during this reaction.

With the acid value below 8.0, the batch was cooled to below 170° C. and the packed column was removed and replaced with a xylene azeotrope. Then, 70.5 grams of maleic anhydride was added to the batch followed by 40.5 grams of xylene. The contents of the batch were heated to 210° C. The batch was held at this temperature until an acid value of 11.5 mg KOH/g resin or below was achieved. Additionally, during this hold, a glycol correction is made to compensate for lost glycol during the reaction. With the acid value below 11.5, the batch was cooled to 160° C. and 33.5 grams of sorbic acid was added to the flask. A mild exotherm was observed. The batch was held for 8 hours at 160° C.

At the end of the 8-hour hold, the xylene azeotrope was removed and the heat source was turned off. Next, 120 g of butyl carbitol was added to the batch over a course of 15 minutes. Once the butyl carbitol was all in, 120 g of butanol was added to the batch. After the addition of the butanol, the batch was cooled until it reached below 80° C. Then, 25.0 grams of 29% ammonia hydroxide was added to the batch in 3 shots over 2 minutes. After a brief stir, 120.0 g of Cymel 303 LF melamine crosslinker (commercially available from Allnex) was added to the batch. The batch was briefly stirred for uniformity and then 3117.0 g deionized water was added to the batch over approximately 90 minutes to complete the batch.

The batch yielded a dispersion of the water-dispersible polyester polymer having about 21 percent solids and a particle size of about 0.09 microns as determined via laser diffraction.

Example 2

Another preparation of a water-dispersible polyester polymer: The following reactants were charged to a 5-liter flask equipped with a stirrer, gas inlet, packed column, condenser, thermocouple, and heat source: 383.31 g Terephthalic acid, 128.61 g Isophthalic acid, 294.00 g 2-methyl-1,3 propanediol, and 108.90 g Cyclohexanedimethanol. Next, 0.91 grams of Fascat 4100 catalyst was added under agitation and the materials were gradually heated under nitrogen to a maximum of 240° C. over the course of about 70 minutes. The reaction was held at this temperature until an acid value below 8.0 was achieved. Approximately 121 milliliters of water were distilled out during this reaction.

When the acid value reached below 8.0, the batch was cooled to below 170° C. and the packed column was removed and replaced with a xylene azeotrope. Then, 70.5 grams of maleic anhydride was added to the batch followed by 40.5 grams of xylene. The contents of the batch were heated to 210° C. The batch was held at this temperature until an acid value of 11.5 or below was achieved. Additionally, during this hold, a glycol correction was made to compensate for lost glycol during the reaction.

With the acid value below 11.5, the batch was cooled to 160° C. and 33.5 grams of sorbic acid was added to the flask. A mild exotherm was observed. The batch was held for 8 hours at 160° C. The sorbic acid reacts with the maleic group in the polymer backbone with the below exemplary reaction scheme:

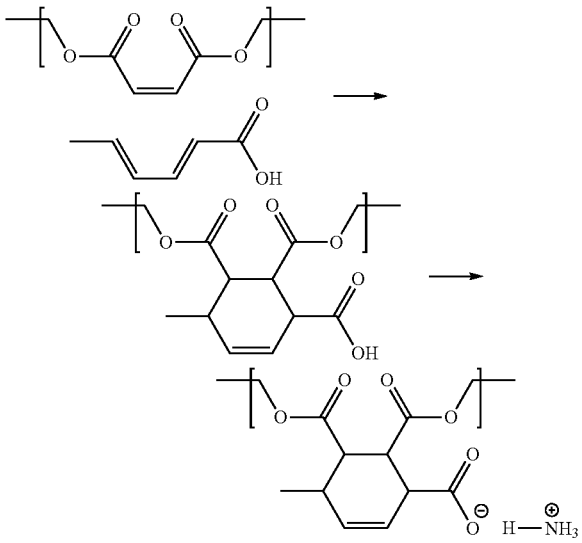

At the end of the 8-hour hold, the xylene azeotrope was removed and the heat source was turned off. Then, 120 g of butyl carbitol was added to the batch over a course of 15 minutes. Once the butyl carbitol was all in, 120 g of butanol was added to the batch. After the addition of the butanol, the batch was cooled until it reached below 80° C. Next, 23.2 g of trimethylamine (TEA) was added to the batch in 3 shots over 2 minutes. After a brief stir, 125.0 g of Cymel 303 LF crosslinker was added to the batch. The batch was briefly stirred for uniformity and then 3104.7 g deionized water was added to the batch over approximately 60 minutes to complete the batch.

The batch yielded a dispersion of the water-dispersible polyester polymer having about 21 percent solids and a particle size of about 0.12 microns as determined via laser diffraction.

Example 3

Preparation of an aqueous coating composition suitable for electrodeposition: The aqueous batch of Example 1 or Example 2 was used to form a 10 percent solids aqueous composition for electrodeposition as follows: The following materials are charged into a 1-gallon plastic container and placed under a mixer: 1714.3 g of the batch of Example 1 or Example 2 including the water dispersible polyester as prepared by that Example; 1885.7 g deionized water; 14.4 g of Michem Lube 160 PF lubricant (commercially available from Michelman); and 9.0 g of Surfynol 104 BC surfactant (commercially available from Palmer Holland) were combined under agitation. The sample was mixed for 30 minutes to form a 10 percent solids aqueous coating composition suitable for an e-coating bath.

Example 4

The e-coat bath composition prepared in Example 3 using the polymer of Example 1 was transferred to a 4000 milliliters (mL) glass beaker with a magnetic stir rod. The beaker was placed on a hot plate. The bath was brought up to 23° C. with the agitation at about 120 revolutions-per-minute (RPM). Then, 2 steel cathodes were placed in the beaker parallel to each other on opposite sides of the beaker. A 5.5 inches by 8 inches aluminum panel was suspended across the middle of the beaker parallel to the cathodes. A current of between 2-5 Amps was applied across the panel and cathodes for 3 seconds to apply the coating with a target film weight of 2.0 milligrams per square inch (msi). The coated panels were then baked to 400° F. peak metal temperature.

The following tests were then performed on the cured e-coating: Blush rating after deionized water pasteurization for 45 minutes at 180° F., Enamel rating of 202 beverage ends before and after pasteurization for 45 minutes at 180° F. and the results provided in the Table below.

TABLE

Performance Results

| WPG (weight/gallon) | Blush | Initial Coating Porosity of 202 Can Ends (mA) | Coating Porosity after Pasteurization of 202 Can Ends (mA) |
|---|---|---|---|
| 8.65 | 9 | 38.1 | 91.0 |
| 8.67 | 10 | 19.8 | 83.7 |

Comparative Example 5

Preparation of a phosphate epoxy water-dispersible polymer: The following reactants were charged to a 5 liter flask equipped with a stirrer, gas inlet, condenser, thermocouple, and heat source: 948.62 g of tetramethylbisphenol F diglycidyl ether and hydroquinone in an appropriate ratio to produce a desired epoxy value target of 0.063 mg KOH/100 g resin, 0.45 g Catalyst 1201 (ETPPI), and 71.5 g Eastman EB solvent to give an in-process solids of 93%.

Once charged, the materials were gradually heated under nitrogen to 1S0C over approximately 30 to 40 minutes to achieve a desired exotherm of less than 200° C. peak temperature. Once peak exotherm was achieved, the batch was cooled to a hold temperature of 165° C. and held for two hours from the peak exotherm. After the two-hour hold was complete, the batch was sampled for epoxy content until a desired epoxy value range of 0.063 to 0.058 was achieved.

Once the epoxy value was achieved, 441.7 g of Eastman EB solvent was added slowly over 20 minutes while cooling to 90° C. At about 90 to 95° C., 12.4 g of super-phosphoric acid (105% Equivalent) was added and the batch held for 60 minutes. After the 60 minute hold was complete, 5.1 g of deionized (DI) water is added, and the batch held for an additional 60 minutes at 90° C.

Once the hold is complete, the batch temperature was set to 70° C. and 14.0 g of dimethylethanolamine, 96.3 g of Cymel 303 LF crosslinker, and 96.3 g of Eastman EB solvent was added in succession over about 10 minutes. Then, 1813.6 g of DI water was added over about 60 minutes while allowing the batch to cool to 70° C. Once the DI water addition was complete, the batch is cooled to below 100° F. and discharged yielding a dispersion of about 30% solids, a pH of about 8.5, a spec 200 particle size of about 0.14 microns, and an acid content of about 8 to about 9 mg KOH/g with a thin easily pourable viscosity.

Example 6

The epoxy of Example 5 was blended with the water reducible polyester from Example 1 to produce 3600 g of E-coat Bath at 10% solids. This blend can vary from 50% Epoxy by solids up to 70% Epoxy by solids. The following preparation represents a 60% epoxy on solids blend.

The following materials were charged into a 1-gallon plastic container and placed under a mixer: 720.0 g of the phosphated epoxy dispersion of Example 5, 685.7 g of the water-dispersible polyester of Example 1, 2194.3 g deionized water, 14.4 g of Michem Lube 160 PF surfactant, and 9.0 g of Surfynol 104 BC surfactant were added under agitation. The sample was mixed for 30 minutes to form the e-coat batch at 10 percent solids.

The complete disclosure of all patents, patent applications, and publications, and electronically available material cited herein are incorporated by reference. The foregoing detailed description and examples have been given for clarity of understanding only. No unnecessary limitations are to be understood therefrom. The disclosure is not limited to the exact details shown and described, for variations obvious to one skilled in the art will be included within the disclosure defined by the claims. The disclosure illustratively disclosed herein suitably may be practiced, in some embodiments, in the absence of any element which is not specifically disclosed herein.

Unless otherwise specified, all measurements herein are made at 23+1° C. and 50% relative humidity. The dimensions and values disclosed herein are not to be understood as being strictly limited to the exact numerical values recited. Instead, unless otherwise specified, such as dimension is intended to mean both the recited value and a functionally equivalent range surrounding that value. All ranges noted are intended to mean any endpoint within that range. For example, a dimension disclosed as "40 mm" is intended to mean "about 40 mm".

Illustrative embodiments have been described, hereinabove. It will be apparent to those skilled in the art that the above compositions and methods may incorporate changes and modifications without departing from the general scope of this disclosure. It is intended to include all such modifications and alterations within the scope of the present disclosure. Furthermore, to the extent that the term "includes" is used in either the detailed description or the claims, such term is intended to be inclusive in a manner similar to the term "comprising" as "comprising" is interpreted when employed as a transitional word in a claim.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A method of coating a beverage end coil substrate in an industrial coating line, the method comprising:

contacting the beverage end coil substrate with an aqueous coating composition, wherein the beverage end coil is positively charged;

electrodepositing coating solids from the aqueous coating composition onto the beverage end coil substrate, wherein the aqueous coating composition includes more than about 60 weight percent, based on resin solids, of a polyester polymer and less than about 1.2 kg/L of volatile organic content as measured pursuant to ASTM 02369-90, based on the total weight of the aqueous coating composition;

curing the electrodeposited coating solids to form a hardened coating on the beverage end coil substrate;

wherein the polyester polymer includes one or more anionic groups located in a pendant group attached to a backbone of the polyester polymer and wherein the pendant group includes a reaction product of an unsaturated compound having at least one salt or salt-forming group, and wherein the pendant group is attached to another portion of the polymer via reaction of the unsaturated compound with one or more double or triple bonds, with the proviso that the reaction of the unsaturated compound with the one or more double or triple bonds does not require the participation of a free-radical initiator; and wherein the unsaturated compound includes sorbic acid, maleic acid, fumaric acid, nadic acid, tetrahydrophthalic acid, anhydride derivatives thereof, or combinations thereof.

2. The method of claim 1, wherein the beverage end coil substrate contacts the aqueous coating composition in a bath, and wherein a given area of the beverage end coil substrate is within the bath for a duration of less than about 10 seconds.

3. The method of claim 1, wherein the anionic groups include base-neutralized acid or anhydride groups.

4. The method of claim 3, wherein the base includes a nitrogen-containing base.

5. The method of claim 4, wherein the base includes an amine.

6. The method of claim 1, wherein the unsaturated compound includes sorbic acid, maleic acid, fumaric acid, nadic acid, tetrahydrophthalic acid, anhydride derivatives thereof, or combinations thereof.

7. A method of electrodepositing coating solids to a surface of a metal beverage end coil substrate, the method comprising:

contacting the metal beverage end coil substrate with an aqueous coating composition;

electrodepositing coating solids from the aqueous coating composition onto a surface of the metal beverage end coil substrate; and wherein the aqueous coating composition includes a polyester polymer; less than about 1.2 kg/L of volatile organic content, based on the total weight of the aqueous coating composition;

curing the electrodeposited coating to form a cured coating on the metal beverage end coil substrate; and wherein the polyester polymer has a cycloaliphatic group and a pendant group attached to the cycloaliphatic group, wherein the pendant cycloaliphatic group includes at least one salt group, wherein the cycloaliphatic group has at least one carbon-carbon double bond present in a ring of the cyclic group, and wherein the cycloaliphatic group and pendant group attached to the cycloaliphatic group is derived from sorbic acid, maleic acid, fumaric acid, nadic acid, tetrahydrophthalic acid, anhydride derivatives thereof, or combinations thereof.

8. The method of claim 7, wherein the pendant group is attached to the cycloaliphatic group via a carbon-carbon bond.

9. The method of claim 7, wherein the polyester polymer has an acid number of about 20 to about 25 mg KOH/g resin.

10. The method of claim 7, wherein the polyester polymer has a hydroxyl number of about 10 to about 20 mg KOH/g resin.

11. The method of claim 7, wherein the polyester polymer is unsaturated.

12. The method of claim 7, wherein the polyester polymer has a glass transition temperature (Tg) as measured by DSC of about 25° C. to about 60° C.

13. The method of claim 7, wherein the polyester polymer has a number average molecular weight determined by GPC using polystyrene standards of at least about 2,000.

14. The method of claim 7, wherein the aqueous coating composition is a concentrate having about 20 to about 30 weight solids.

15. The method of claim 14, wherein the concentrate is diluted to about 5 to about 12 weight percent solids for the electrodepositing.

16. The method of claim 7, wherein a particle size of the polyester polymer in the aqueous coating composition is about 0.05 to about 0.15 microns as measured by laser diffraction.

17. The method of claim 7, wherein the cycloaliphatic group and pendent group attached to the cycloaliphatic group is derived from sorbic acid.

* * * * *